US008712284B2

(12) United States Patent
Toba et al.

(10) Patent No.: US 8,712,284 B2
(45) Date of Patent: Apr. 29, 2014

(54) PROCESS CARTRIDGE AND ELECTROPHOTOGRAPHIC IMAGE FORMING APPARATUS

(71) Applicant: Canon Kabushiki Kaisha, Tokyo (JP)

(72) Inventors: Shinjiro Toba, Yokohama (JP); Akira Yoshimura, Suntou-gun (JP); Susumu Nittani, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/890,453

(22) Filed: May 9, 2013

(65) Prior Publication Data

US 2013/0243481 A1 Sep. 19, 2013

Related U.S. Application Data

(62) Division of application No. 13/407,190, filed on Feb. 28, 2012, now abandoned, which is a division of application No. 12/949,968, filed on Nov. 19, 2010, now Pat. No. 8,213,831, which is a division of application No. 12/164,766, filed on Jun. 30, 2008, now Pat. No. 7,860,433.

(30) Foreign Application Priority Data

Jun. 29, 2007 (JP) ..... 2007-172742
Jun. 20, 2008 (JP) ..... 2008-162311

(51) Int. Cl.
*G03G 21/16* (2006.01)

(52) U.S. Cl.
USPC ..... 399/111; 399/107; 399/119

(58) Field of Classification Search
USPC ..... 399/107, 110, 111, 115, 117, 119, 125, 399/126
See application file for complete search history.

(56) References Cited

U.S. PATENT DOCUMENTS 5,283,616 A 2/1994 Numagami et al.
5,500,714 A 3/1996 Yashiro et al.

(Continued)

FOREIGN PATENT DOCUMENTS

EP 1231523 8/2002
EP 1 519 248 3/2005

(Continued)

OTHER PUBLICATIONS

PCT International Search Report and Written Opinion of International Search Authority in PCT/JP2008/062243 issued Nov. 27, 008.

(Continued)

*Primary Examiner* — Walter L Lindsay, Jr.
*Assistant Examiner* — Barnabas Fekete
(74) *Attorney, Agent, or Firm* — Fitzpatrick, Cella, Harper & Scinto

(57) ABSTRACT

A process cartridge detachably mountable to a main assembly of an electrophotographic image forming apparatus, includes an electrophotographic photosensitive drum, a developing roller, a drum frame, a movable developing frame taking a position where the roller contacts the drum, and a force receiver having first and second force receivers for receiving first and second external forces. The second force receiver moves relative to the developing frame. The second force receiver takes a stand-by position retracted from an operating position when the first force receiver receives the first external force, and moves from the stand-by to the operating position for moving the developing frame from the contacting position to the spacing position. The distance the second force receiver moves from the stand-by to the operating position is larger than the distance the first force receiver moves by the first external force.

13 Claims, 21 Drawing Sheets

(56) References Cited

U.S. PATENT DOCUMENTS

| | | | |
|---|---|---|---|
| 5,543,898 | A | 8/1996 | Shishido et al. |
| 5,585,895 | A | 12/1996 | Yashiro et al. |
| 5,617,579 | A | 4/1997 | Yashiro et al. |
| 5,619,309 | A | 4/1997 | Yashiro et al. |
| 5,638,161 | A | 6/1997 | Numagami et al. |
| 5,652,647 | A | 7/1997 | Yashiro et al. |
| 5,689,774 | A | 11/1997 | Shishido et al. |
| 5,768,658 | A | 6/1998 | Watanabe et al. |
| 5,790,923 | A | 8/1998 | Oguma et al. |
| 5,920,753 | A | 7/1999 | Sasaki et al. |
| 5,937,239 | A | 8/1999 | Watanabe et al. |
| 5,937,242 | A | 8/1999 | Yokoyama et al. |
| 5,953,560 | A | 9/1999 | Numagami et al. |
| 5,966,566 | A | 10/1999 | Odagawa et al. |
| 5,966,568 | A | 10/1999 | Numagami et al. |
| 6,006,058 | A | 12/1999 | Watanabe et al. |
| 6,016,413 | A | 1/2000 | Yokoyama et al. |
| 6,029,032 | A | 2/2000 | Watanabe et al. |
| 6,064,842 | A | 5/2000 | Takeuchi et al. |
| 6,097,908 | A | 8/2000 | Uchiyama et al. |
| 6,097,909 | A | 8/2000 | Watanabe et al. |
| 6,101,354 | A | 8/2000 | Nakagawa et al. |
| 6,118,960 | A | 9/2000 | Nakagawa et al. |
| 6,131,007 | A | 10/2000 | Yamaguchi et al. |
| 6,157,792 | A | 12/2000 | Mori et al. |
| 6,169,866 | B1 | 1/2001 | Watanabe et al. |
| 6,246,849 | B1 | 6/2001 | Yokoyama et al. |
| 6,266,500 | B1 | 7/2001 | Numagami et al. |
| 6,272,299 | B1 | 8/2001 | Numagami et al. |
| 6,289,189 | B1 | 9/2001 | Numagami et al. |
| 6,308,028 | B1 | 10/2001 | Yashiro et al. |
| 6,330,409 | B1 | 12/2001 | Waanabe et al. |
| 6,385,416 | B1 | 5/2002 | Horikawa et al. |
| 6,408,142 | B1 | 6/2002 | Takeuchi et al. |
| 6,424,811 | B1 | 7/2002 | Tsuda et al. |
| 6,442,359 | B1 | 8/2002 | Numagami et al. |
| 6,459,869 | B2 | 10/2002 | Nittani et al. |
| 6,463,233 | B2 | 10/2002 | Kojima et al. |
| 6,463,234 | B2 | 10/2002 | Arimitsu et al. |
| 6,542,706 | B2 | 4/2003 | Toba et al. |
| 6,549,736 | B2 | 4/2003 | Miyabe et al. |
| 6,577,831 | B1 | 6/2003 | Kojima et al. |
| 6,603,939 | B1 | 8/2003 | Toba et al. |
| 6,608,980 | B2 | 8/2003 | Murayama et al. |
| 6,678,488 | B2 | 1/2004 | Toba et al. |
| 6,681,088 | B2 | 1/2004 | Kanno et al. |
| 6,714,752 | B2 | 3/2004 | Ueno et al. |
| 6,823,153 | B2 | 11/2004 | Ueno et al. |
| 6,834,171 | B2 | 12/2004 | Nittani et al. |
| 6,836,629 | B2 | 12/2004 | Miyabe et al. |
| 6,898,391 | B2 | 5/2005 | Numagami et al. |
| 6,912,365 | B2 | 6/2005 | Ueno et al. |
| 6,937,834 | B2 | 8/2005 | Kanno et al. |
| 6,954,601 | B2 | 10/2005 | Numagami et al. |
| 6,980,758 | B2 | 12/2005 | Murayama et al. |
| 6,980,759 | B2 | 12/2005 | Kanno et al. |
| 6,990,302 | B2 | 1/2006 | Toba et al. |
| 7,024,137 | B2 | 4/2006 | Nitani et al. |
| 7,027,603 | B2 | 4/2006 | Taenzer |
| 7,072,603 | B2 | 7/2006 | Tsuzuki et al. |
| 7,088,939 | B2 | 8/2006 | Maeshima et al. |
| 7,127,194 | B2 | 10/2006 | Hoshi et al. |
| 7,149,457 | B2 | 12/2006 | Miyabe et al. |
| 7,158,735 | B2 | 1/2007 | Murayama et al. |
| 7,158,736 | B2 | 1/2007 | Sato et al. |
| 7,162,174 | B2 | 1/2007 | Suzuki et al. |
| 7,164,875 | B2 | 1/2007 | Miyabe et al. |
| 7,184,682 | B2 | 2/2007 | Chadani et al. |
| 7,184,690 | B2 | 2/2007 | Ueno et al. |
| 7,209,682 | B2 | 4/2007 | Numagami et al. |
| 7,212,768 | B2 | 5/2007 | Numagami et al. |
| 7,215,909 | B2 | 5/2007 | Nitani et al. |
| 7,248,810 | B2 | 7/2007 | Miyabe et al. |
| 7,272,339 | B2 | 9/2007 | Tsuzuki et al. |
| 7,298,990 | B2 | 11/2007 | Nishimura |
| 7,319,827 | B2 | 1/2008 | Yoshizawa |
| 7,386,241 | B2 | 6/2008 | Mori et al. |
| 7,433,622 | B2 | 10/2008 | Chadani et al. |
| 7,463,844 | B2 | 12/2008 | Hashimoto et al. |
| 2003/0049046 | A1 | 3/2003 | Okabe |
| 2003/0156848 | A1 | 8/2003 | Kawai et al. |
| 2005/0260011 | A1 | 11/2005 | Murayama et al. |
| 2006/0177231 | A1 | 8/2006 | Mori et al. |
| 2006/0245785 | A1 | 11/2006 | Kawamura et al. |
| 2006/0257164 | A1 | 11/2006 | Hoshi et al. |
| 2007/0053716 | A1 | 3/2007 | Itabashi |
| 2007/0092286 | A1 | 4/2007 | Suzuki et al. |
| 2007/0110478 | A1 | 5/2007 | Numagami et al. |
| 2007/0147890 | A1 | 6/2007 | Hayakawa |
| 2007/0160388 | A1 | 7/2007 | Yoshimura et al. |
| 2008/0152388 | A1 | 6/2008 | Ueno et al. |
| 2008/0159772 | A1 | 7/2008 | Koishi et al. |
| 2008/0159773 | A1 | 7/2008 | Murayama et al. |
| 2008/0159774 | A1 | 7/2008 | Tanabe et al. |
| 2008/0159775 | A1 | 7/2008 | Koishi et al. |

FOREIGN PATENT DOCUMENTS

| | | | |
|---|---|---|---|
| EP | 1 621 942 | | 2/2006 |
| JP | 2003167499 | | 6/2003 |
| JP | 2005-099517 | A | 4/2005 |
| JP | 2005-242067 | A | 9/2005 |
| JP | 2006-065267 | A | 3/2006 |
| JP | 2006-259448 | A | 9/2006 |
| JP | 2006-337413 | A | 12/2006 |
| RU | 2 289 835 | | 12/2006 |
| WO | 2007081042 | | 7/2007 |

OTHER PUBLICATIONS

Search and Examination Report in Singapore Patent Application No. 2009073842, dated Nov. 1, 2011.

Search Report and Written Opinion in Singapore Patent Application No. 200907384-2, Apr. 19, 2011.

Notice of Allowance in Korean Patent Application No. 10-2011-7024581, mailed Dec. 28, 2012.

Decision on Grant in Russian Patent Application No. 201002895/25, mailed Nov. 30, 2011.

Notice of Allowance in Korean Patent Application No. 10-2010-7001460, mailed Mar. 29, 2012.

Taiwan Notice of Allowance dated Aug. 30, 2013, issued in corresponding Taiwan Patent Application No. 097124565.

Korean Notice of Allowance dated Sep. 5, 2013, issued in corresponding Korean Patent Application No. 10-2012-7019935.

Notice of Allowance in Korean Patent Application No. 10-2013-7021050, mailed Nov. 20, 2013.

Decision on Grant in Russian Patent Application No. 201205546/28(008445), mailed Feb. 7, 2014 (with English translation).

(a)

(b)

(a)

(b)

PROCESS CARTRIDGE AND ELECTROPHOTOGRAPHIC IMAGE FORMING APPARATUS

This application is a divisional of application Ser. No. 13/407,190, filed Feb. 28, 2012, which is a divisional of application Ser. No. 12/949,968, filed Nov. 19, 2010, now U.S. Pat. No. 8,213,831, which is a divisional of application Ser. No. 12/164,766, filed Jun. 30, 2008, now U.S. Pat. No. 7,860,433.

FIELD OF THE INVENTION AND RELATED ART

The present invention relates to a process cartridge made up of an electrophotographic photosensitive drum and a development roller (which performs processes on a photosensitive drum), in particular, a process cartridge, the electrophotographic photosensitive drum and development roller of which can be placed in contact with, or separated from, each other. The present invention also relates to an electrophotographic image forming apparatus employing the above described process cartridge.

In recent years, a process cartridge system has come to be widely used in the field of an image forming apparatus which uses an electrophotographic image forming process. A process cartridge system is one of the electrophotographic image forming systems. It uses a cartridge in which an electrophotographic photosensitive drum, and a development roller, that is, a roller for processing an electrophotographic photosensitive drum, are integrally disposed to make them removably mountable in the main assembly of an image forming apparatus. Thus, the employment of a process cartridge system makes it possible for a user to maintain an electrophotographic image forming apparatus without relying on a service person. This is why a process cartridge system has come to be widely used in the field of an electrophotographic image forming apparatus.

A process cartridge is structured so that its development roller is kept pressured toward its electrophotographic photosensitive drum with the application of a preset amount of pressure, in order to keep the development roller in contact with the photosensitive drum when forming an image. In the case of a so-called contact development method, that is, a development method which places a development roller in contact with a photosensitive drum to develop a latent image on the photosensitive drum, the elastic layer of the development roller is kept pressed upon the peripheral surface of the photosensitive drum so that a preset amount of contact pressure is maintained between the peripheral surface of the development roller and that of the photosensitive drum.

Therefore, if a process cartridge is left unused in the main assembly of an image forming apparatus for a substantial length of time, the elastic layer of the development roller sometimes deforms. Thus, if an image forming apparatus in which a process cartridge has been left unused for a substantial length of time is used for the first time thereafter, it is possible that a latent image will be nonuniformly developed. Further, in the case of a so-called contact development method, a development roller is in contact with a photosensitive drum during development. Therefore, developer sometimes transfers from a development roller onto the points of the peripheral surface of a photosensitive drum, to which developer is not supposed to adhere. Further, not only do a photosensitive drum and a development roller rotate in contact with each other during development, but also, during processes other than development. Therefore, a so-called contact development method exacerbates the deterioration of a photosensitive drum, a development roller, and developer.

One of the solutions to the above described problem is proposed in Japanese Laid-open Patent Application 2003-167499. According to this patent application, an image forming apparatus is provided with a mechanism which acts on a process cartridge to keep an electrophotographic photosensitive drum and a development roller separated from each other when an image is not actually being formed (Patent Document 1).

In the case of the image forming apparatus proposed in Patent Document 1, its main assembly is structured so that four process cartridges are removably mountable in the main assembly. Each cartridge is made up of a photosensitive member unit and a development unit. The photosensitive member unit has a photosensitive member. The development unit supports a development unit, and is connected to the photosensitive member unit so that it can be rotationally moved relative to the photosensitive member unit. Further, the main assembly of the image forming apparatus is provided with a separation plate, whereas the process cartridge is provided with a force receiving portion. As the separation plate is moved, the force receiving portion receives the force from the separation plate, causing the development unit to move relative to the photosensitive member unit. As a result, the development roller, which was in contact with the photosensitive drum, separates from the photosensitive drum.

According to the prior art, the force receiving portion, that is, the portion which catches the force for separating a development roller and a photosensitive member from each other, remains projecting beyond the external contour of the development unit. Therefore, it is liable to be damaged while a user handles a process cartridge, or a process cartridge is conveyed alone. Further, the presence of the above described force receiving portion has been one of the major problems which arose when studies were made to reduce in size a process cartridge structured so that its electrophotographic photosensitive member and development roller can be placed in contact with, or separated from, each other, and also, when studies were made to reduce in size the main assembly of an image forming apparatus in which such a process cartridge as the one described above is removably mountable.

SUMMARY OF THE INVENTION

The primary object of the present invention is to provide a process cartridge, the electrophotographic photosensitive drum and development roller of which can be placed in contact with, or separated from, each other, and which is significantly smaller in size than its counterpart in the prior art, and also, to provide an electrophotographic image forming apparatus which is compatible with a process cartridge in accordance with the present invention, is removably mountable, and is significantly smaller in size than its counterpart in the prior art.

Another object of the present invention is to provide a process cartridge, the electrophotographic photosensitive member and development roller of which can be placed in contact with, or separated from, each other, and the development unit moving force receiving portion of which is significantly less liable to be damaged while the process cartridge is handled by a user, or transported alone, than its counterpart in the prior art.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

Next, referring to FIGS. 1-4, the process cartridges and electrophotographic image forming apparatuses in this preferred embodiment of the present invention will be described.

Figure 1:
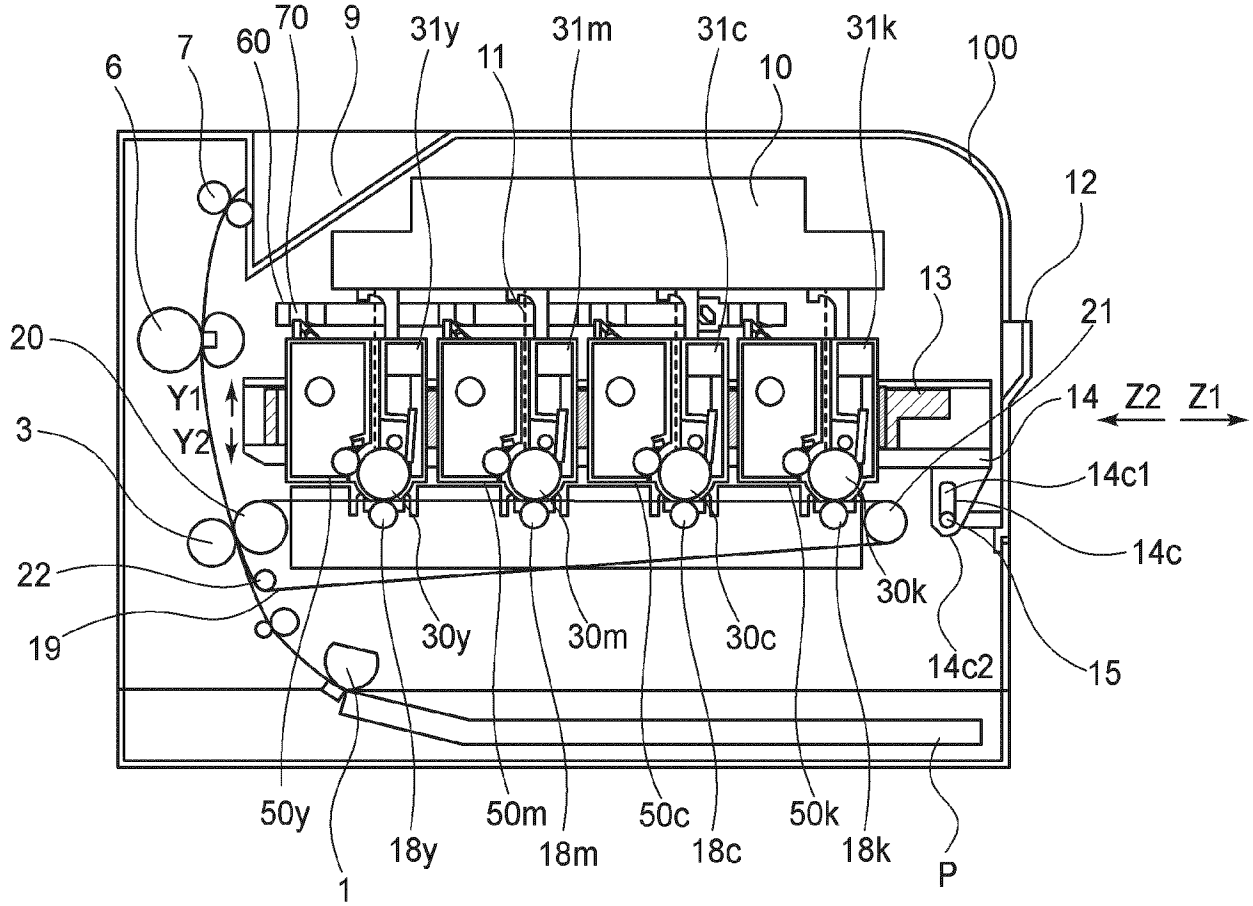
FIG. 1 is a schematic sectional view of the electrophotographic image forming apparatus in the first embodiment of the present invention, showing the general structure of the apparatus.
Figure 2:
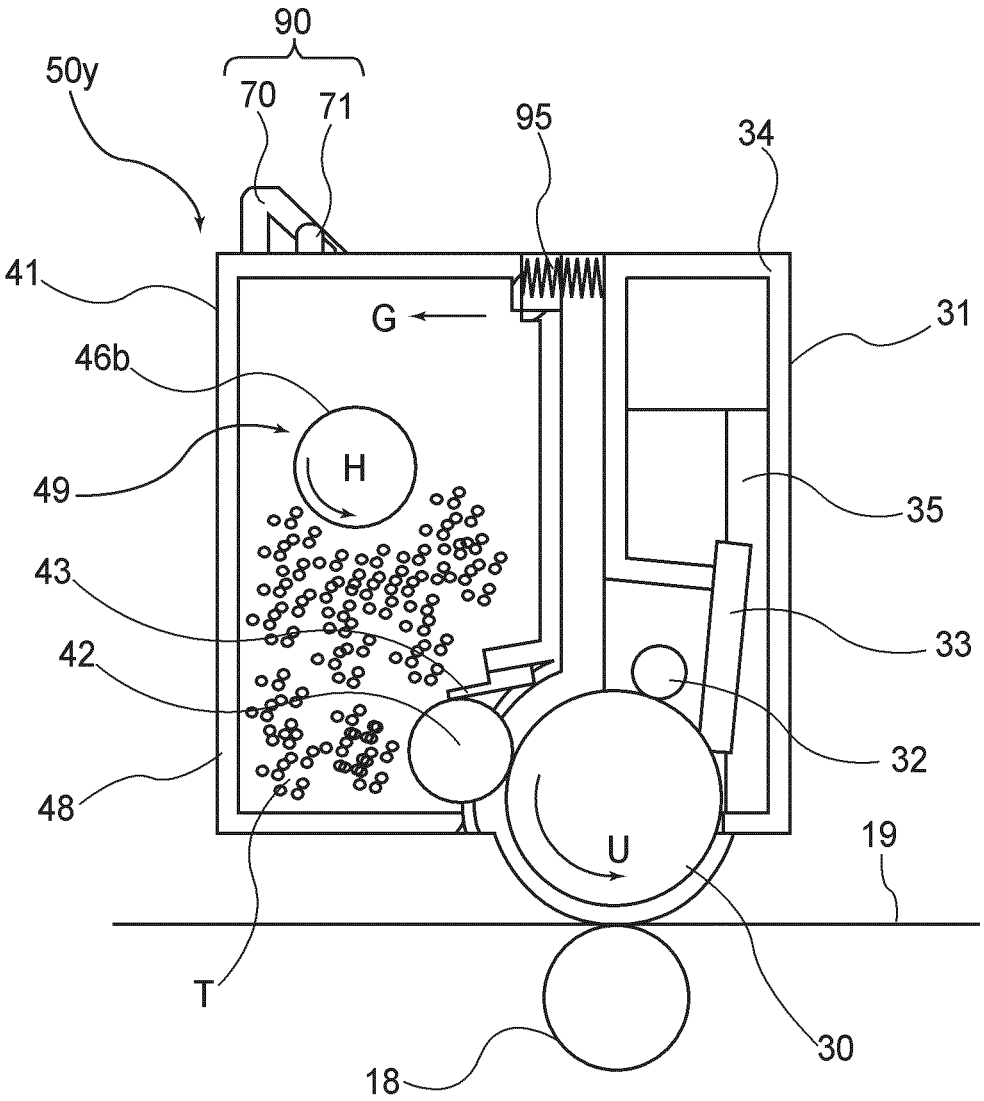
FIG. 2 is a schematic sectional view of the process cartridge in the first embodiment of the present invention.
Figure 3:
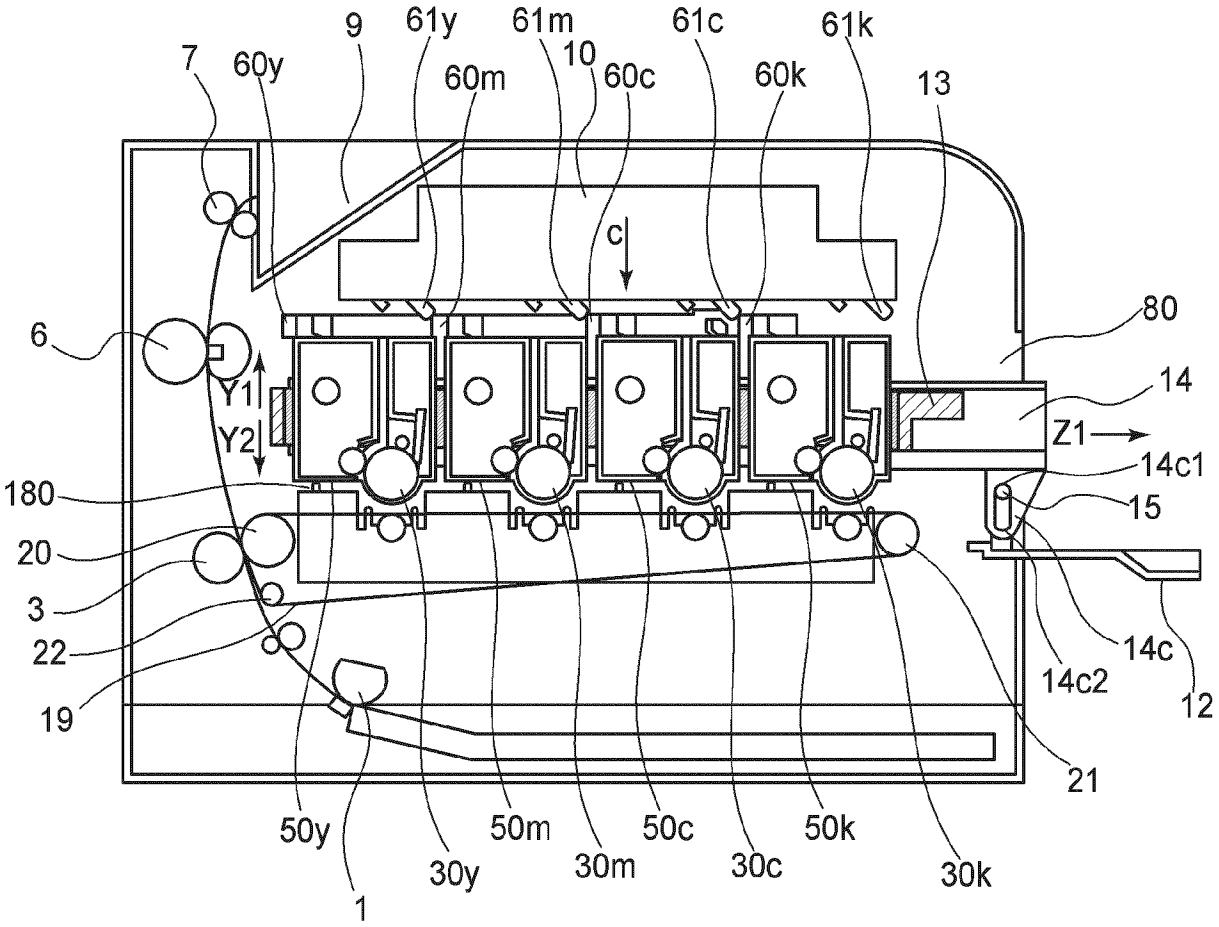
FIG. 3 is also a schematic sectional view of the electrophotographic image forming apparatus in the first embodiment of the present invention, showing the general structure of the apparatus.
Figure 4:
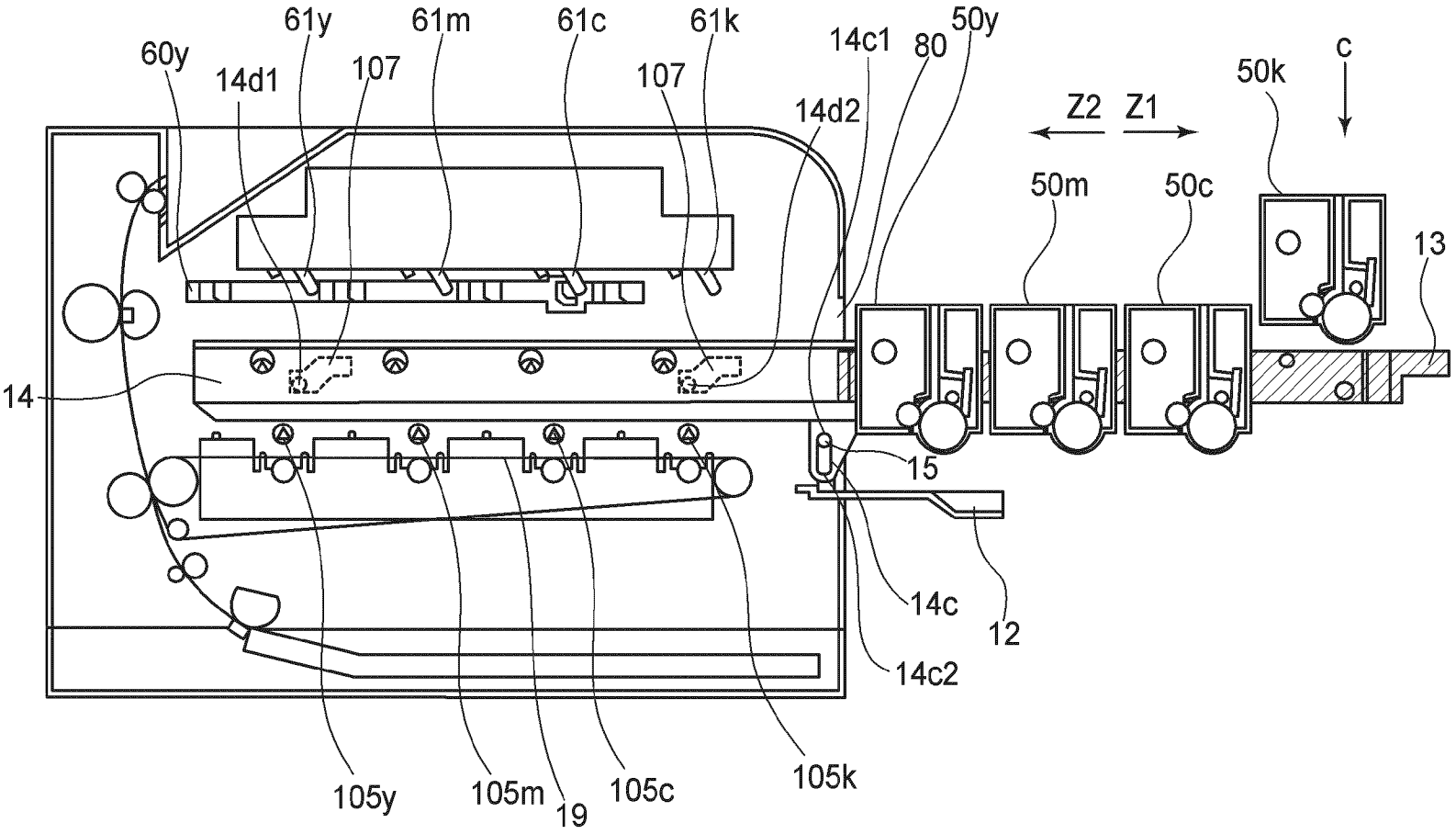
FIG. 4 is another schematic sectional view of the electrophotographic image forming apparatus in the first embodiment of the present invention, showing how the process cartridges therein are replaced.

FIG. 1 is a schematic sectional view of the electrophotographic image forming apparatus 100 (which hereafter will be referred to simply as apparatus main assembly), in which multiple (four) process cartridges 50*y*, 50*m*, 50*c*, and 50*k* (which hereafter may be referred to simply as cartridges 50) which have been removably mounted. The multiple (four) cartridges 50 store yellow, magenta, cyan, and black toners (developers), one for one. FIG. 2 is a schematic sectional view of the cartridge itself. FIGS. 3 and 4 are schematic sectional drawings of the electrophotographic image forming apparatus in this embodiment, which are for showing how the cartridge or cartridges 50 are removed from the main assembly of the image forming apparatus.

{General Structure of Electrophotographic Image Forming Apparatus}

The electrophotographic image forming apparatus in this embodiment is structured to carry out the following image forming operation. Referring to FIG. 1, first, the uniformly charged area of the peripheral surface of each of the electrophotographic photosensitive drums (which hereafter will be referred to as photosensitive drums) 30*y*, 30*m*, 30*c*, and 30*k* is scanned by a beam of laser light 11 projected by a laser scanner 10, with which the apparatus main assembly 100 is provided, while being modulated with pictorial signals. As a result, an electrostatic latent image is effected on the peripheral surface of each photosensitive drum 30. This electrostatic latent image is developed by a development roller 42, into a visible image; an image is formed of toner (developer) on the peripheral surface of the photosensitive drum 30. In other words, yellow, magenta, cyan, and black toner images are formed on the photosensitive drums 30*y*, 30*m*, 30*c*, and 30*k*, respectively. Then, these toner images are sequentially transferred by the voltages applied to transfer rollers 18*y*, 18*m*, 18*c*, and 18*k*, onto a transfer belt 19 supported and stretched by rollers 20-22. Thereafter, the toner images on the transfer belt 19 are transferred by a transfer roller 3, onto a sheet of a recording medium P delivered by a recording medium conveyance roller 1 as a recording medium conveying means. Then, the recording medium P is conveyed to a fixation unit 6 made up of a driver roller, and a fixation roller having an internal heater. In the fixation unit 6, heat and pressure are applied to the recording medium P and the toner images thereon. As a result, the toner images on the recording medium P are fixed to the recording medium P. Then, the recording medium P is discharged onto a delivery tray 9 by a pair of discharge rollers 7.

{General Structure of Process Cartridge}

Next, referring to FIGS. 1, 2 and 10, the cartridges 50 in this embodiment will be described. The multiple (four) cartridges 50 in this embodiment are the same in structure although they are different in the color of the toner T they store. Thus, the structure of the cartridges 50 will be described with reference to the cartridge 50*y*.

The cartridge 50*y* is provided with a photosensitive drum 30, and processing means which perform processes on the photosensitive drum 30. The processing means in this embodiment are a charge roller 32 which is the charging means for charging the photosensitive drum 30, a development roller 42 which is the developing means for developing a latent image formed on the photosensitive drum 30, a blade 33 which is the cleaning means for removing the residual toner remaining on the peripheral surface of the photosensitive drum 30, etc. The cartridge 50*y* is made up of a drum unit 31 and a development unit 41.

{Structure of Drum Unit}

Figure 9:
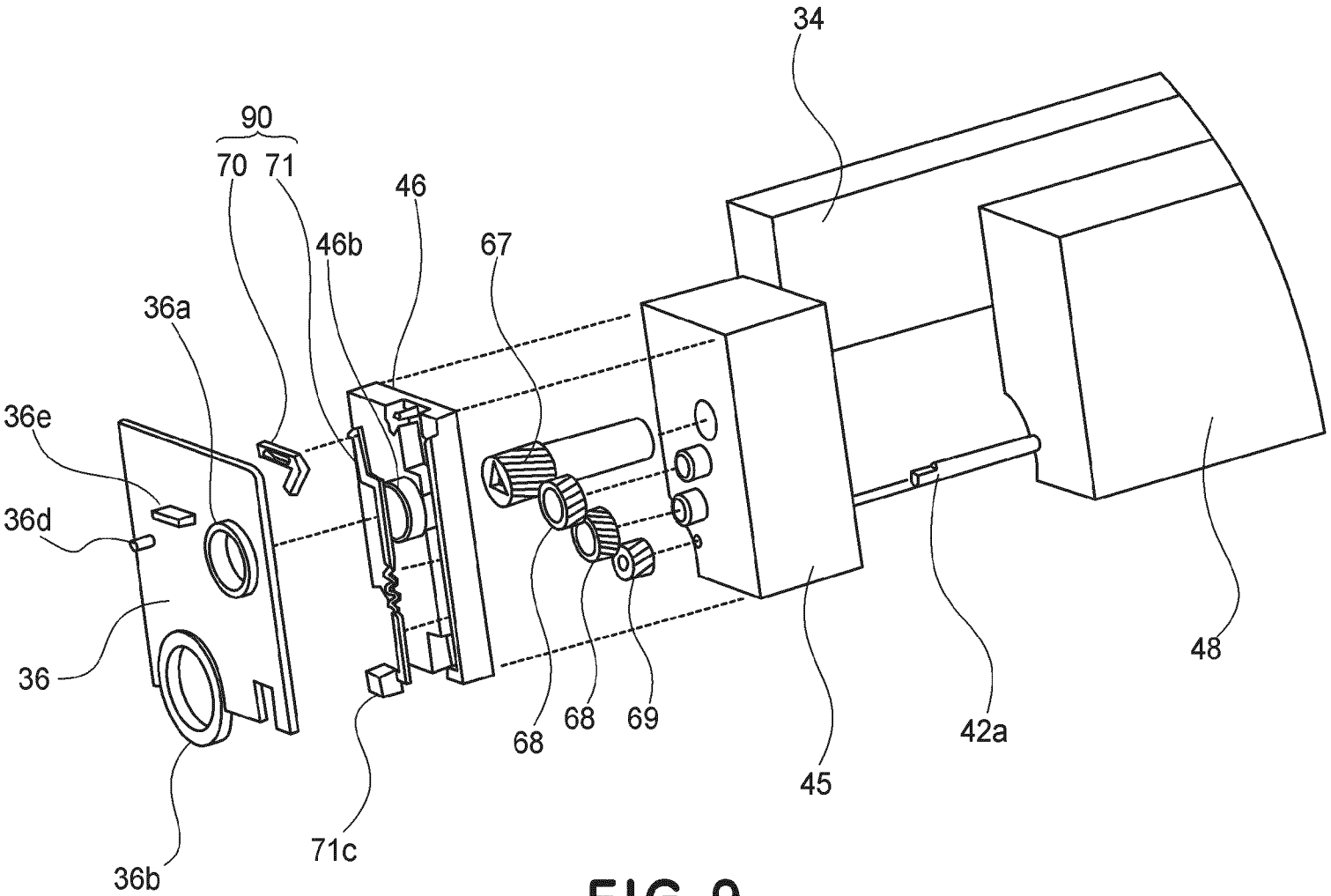
FIG. 9 is an exploded perspective view of the process cartridge in the first embodiment of the present invention.
Figure 10:
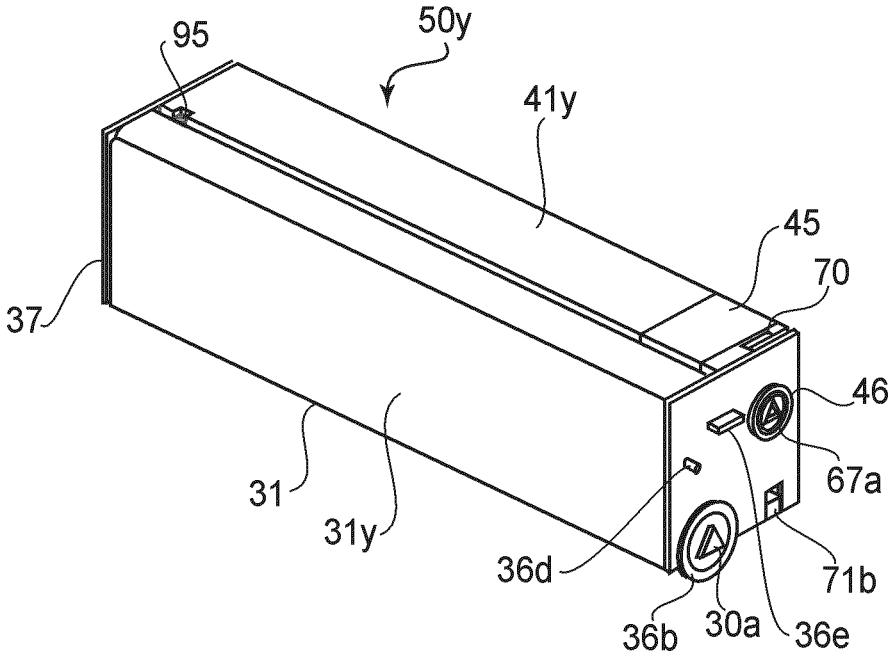
FIG. 10(*a*) is a perspective view of the process cartridge in the first embodiment of the present invention, as seen from the side from which the cartridge is driven, and FIG. 10(*b*) is a perspective view of the process cartridge in the first embodiment of the present invention, as seen from the side opposite from the side from which the cartridge is driven.
Figure 10:
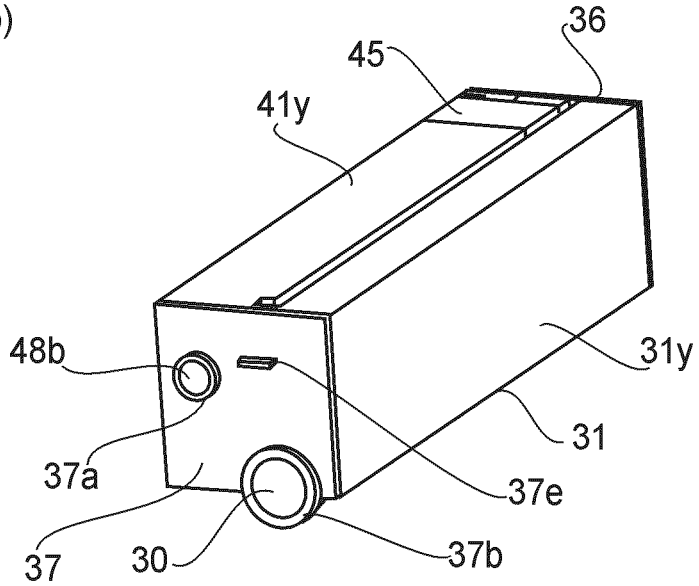

Referring to FIGS. 2, 10(*a*) and 10(*b*), the drum unit 31 includes the abovementioned photosensitive drum 30, the charge roller 32, and the blade 33. It also includes a waste toner storing portion 35, a drum unit main frame 34, and lateral covers 36 and 37 (each of which hereafter will be referred to simply as a cover). Referring to FIG. 9, one of the lengthwise end portions of the photosensitive drum 30 is rotatably supported by the supporting portion 36*b* of the cover 36, whereas the other lengthwise end of the photosensitive drum 30 is rotatably supported by the supporting portion 37*b* of the cover 37 as shown in FIGS. 10(*a*) and 10(*b*). The covers 36 and 37 are attached to the lengthwise ends of the drum unit main frame 34. Next, referring to FIG. 10(*b*), the lengthwise end portion of the photosensitive drum 30, which is supported by the cover 36, is provided with a coupling member 30*a* for transmitting driving force to the photosensitive drum 30. The coupling member 30*a* engages with a first coupling member 105*y* of the apparatus main assembly 100, shown in FIG. 4, as the cartridge 50*y* is mounted into the apparatus main assembly 100. Thus, as a driving force is transmitted from a motor (unshown) with which the apparatus main assembly 100 is provided, to the coupling member 30*a*, the photosensitive drum 30 rotates in the direction indicated by an arrow mark U in FIG. 2. The charge roller 32 is supported by the drum unit main frame 34 so that it is rotated in contact with the photosensitive drum 30 by the rotation of the photosensitive drum 30. The blade 33 is supported also by the drum unit main frame 34 so that it remains in contact with the peripheral surface of the photosensitive drum 30 with the presence of a preset amount of pressure between the blade 33 and the peripheral surface of the photosensitive drum 30. The covers 36 and 37 are provided with holes 36*a* (FIG. 9) and 37*a* (FIG. 10(*b*)) for supporting the development unit 40 in such a manner that the development unit 40 is rotationally movable relative to the drum unit 31.

{Structure of Development Unit}

Figure 17:
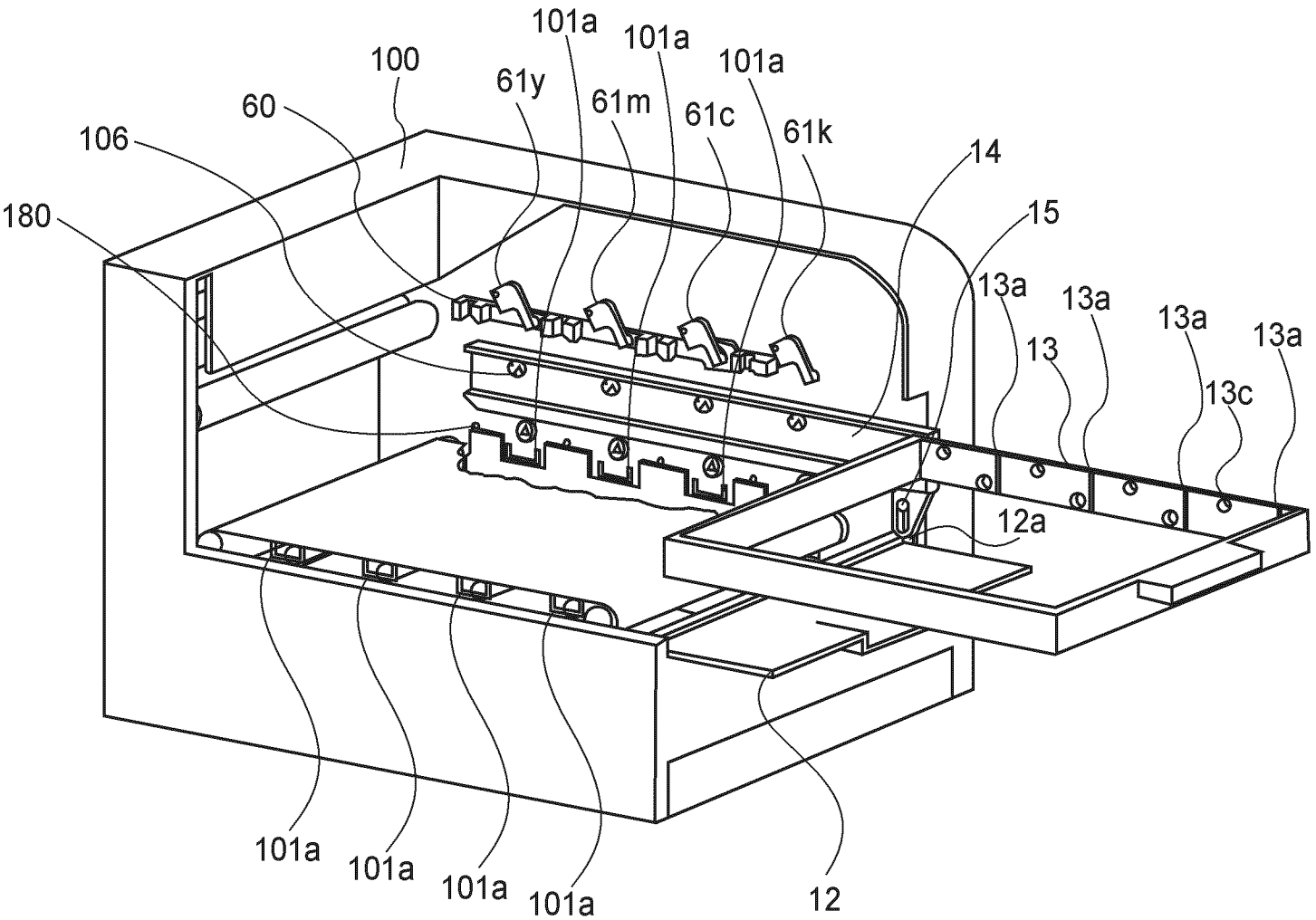
FIG. 17 is a partially cutaway perspective view of the electrophotographic image forming apparatus in the first embodiment of the present invention.

Referring to FIGS. 2 and 9, the development unit 41 has the abovementioned development roller 42. It also has a development blade 43, a development unit main frame 48, a bearing unit 45, and a pair of lateral covers 46. The development unit main frame 48 has a toner storage portion 49 in which the toner to be supplied to the development roller 42 is stored. It supports the development blade 43 which regulates the thickness to which toner is coated on the peripheral surface of the development roller 42. Referring to FIG. 9, the bearing unit 45 is firmly attached to one of the lengthwise end portions of the development unit main frame 48. It rotatably supports the development roller 42, one of the lengthwise end portions of which has a development roller gear 69. Further, the bearing unit 45 is provided with an idler gear 68, which transmits a driving force from a coupling member 67 to the development roller gear 69. The cover 46 is securely attached to the outward side of the bearing unit 45, in terms of the lengthwise direction of the bearing unit 45, in a manner to cover the coupling member 67 and the idler gear 68. Further, the cover 46 is provided with a cylindrical portion 46*b*, which protrudes outward from the outward surface of the cover 46. The coupling member 67 is exposed through the hollow of the cylindrical portion 46*b*. The apparatus main assembly 100 and process cartridge 50*y* are structured so that as the process cartridge 50*y* is mounted into the apparatus main assembly 100, the coupling member 67 engages with the second coupling 106 of the apparatus main assembly 100, which is shown in FIG. 17, transmitting thereby a driving force from the motor (unshown) with which the apparatus main assembly 100 is provided, to the process cartridge 50*y*.

{Connection of Development Unit to Drum Unit}

Figure 11:
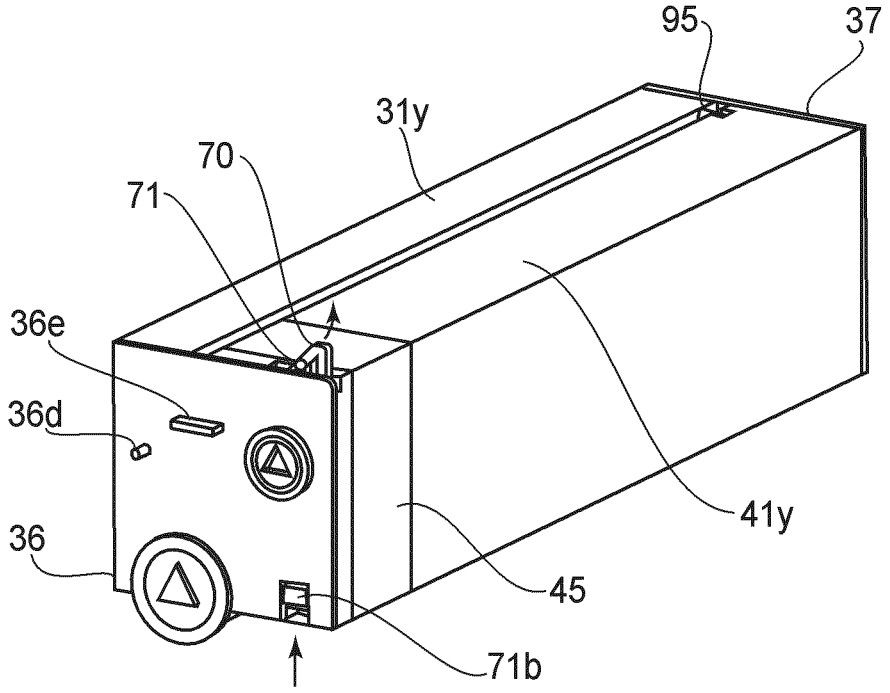
FIG. 11 is a perspective view of the process cartridge in the first embodiment of the present invention, as seen from the side from which the cartridge is driven.

Referring to FIGS. 9-11, the development unit 41 and the drum unit 31 are connected in the following manner: First, at one end of the process cartridge 50*y*, the cylindrical portion 46*b* is fitted into the supporting hole 36*a*. At the other end, a projection 48*b* which projects from the development unit main frame 48 is fitted into the supporting hole 37*a*. As a result, the development unit 41 is connected to the drum unit 31 in such a manner that the development unit 41 is rotationally movable relative to the drum unit 31. Next, referring to FIG. 2, the development unit 41 is kept pressured by a pair of compression springs 95, which are elastic members, in the direction to be rotated about the axial line of the cylindrical portion 46*b* so that the development roller 42 is kept in contact with the photosensitive drum 30. That is, the development unit 41 is kept pressed by the resiliency of the compression springs 95 in the direction indicated by a narrow mark G, generating a moment H which acts in the direction to rotate the development unit 41 about the cylindrical portion 46*b* and projection 48*b*. Thus, the development roller 42 is kept in contact with the photosensitive drum 30 with the presence of the preset amount of contact pressure between the development roller 42 and photosensitive drum 30. The position in which the development unit 41 is when it is kept in contact with the photosensitive drum 30 is referred to as the "contact position".

Referring to FIG. 10(*a*), the compression spring 95 in this embodiment is located on the opposite side from one of the lengthwise end portions, where the coupling member 30*a* of the photosensitive drum 30, and the coupling member 67 which transmits the driving force to the development roller gear 69, are located.

{Force Receiving Apparatus}

Referring to FIG. 2, the cartridge 50*y* is provided with a force receiving apparatus 90 for placing the development roller 42 and the photosensitive drum 30 in contact with each other, or separating them from each other, in the apparatus main assembly 100.

Figure 6:
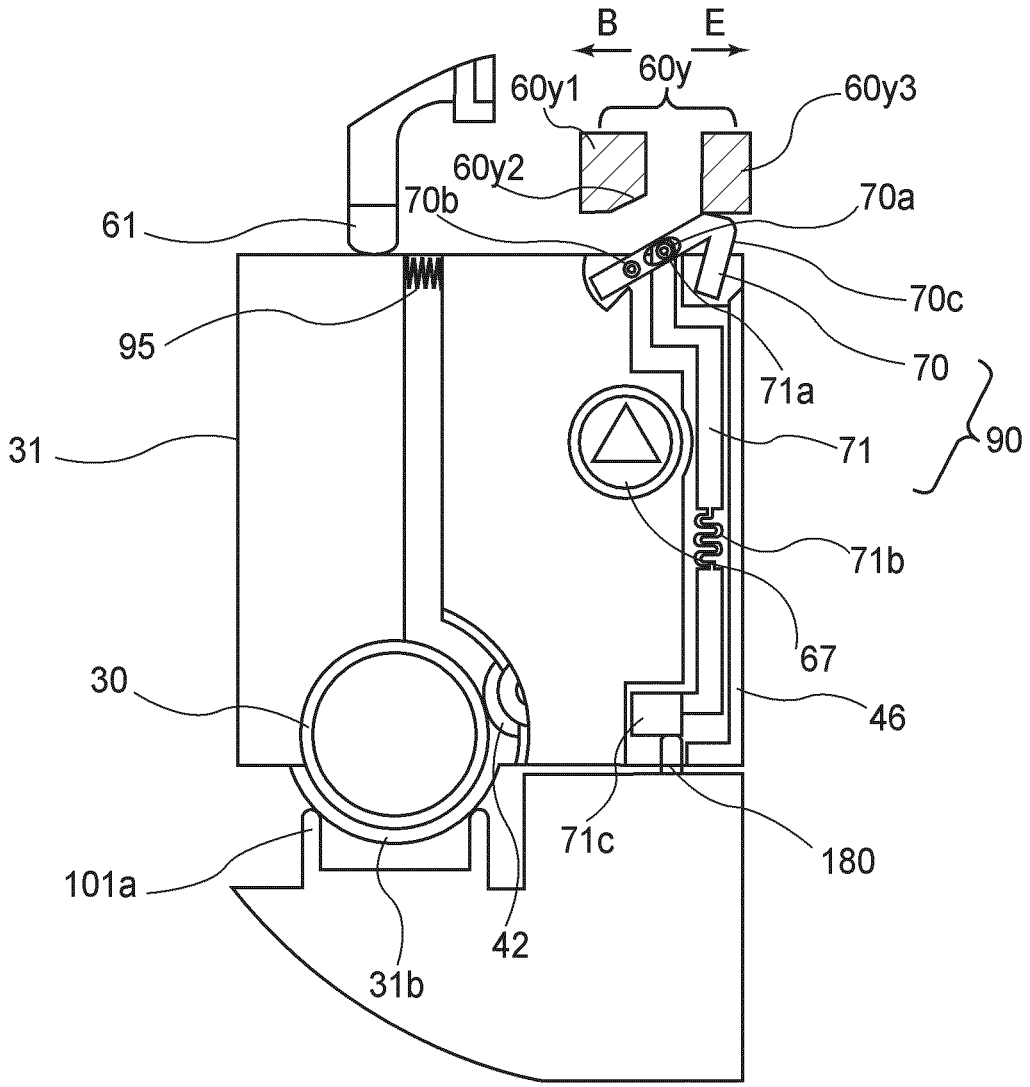
FIG. 6 is a schematic sectional view of the process cartridge in the first embodiment of the process cartridge, showing the movement of the structural components of the cartridge, which is related to the mounting of the process cartridge into the apparatus main assembly.
Figure 8:
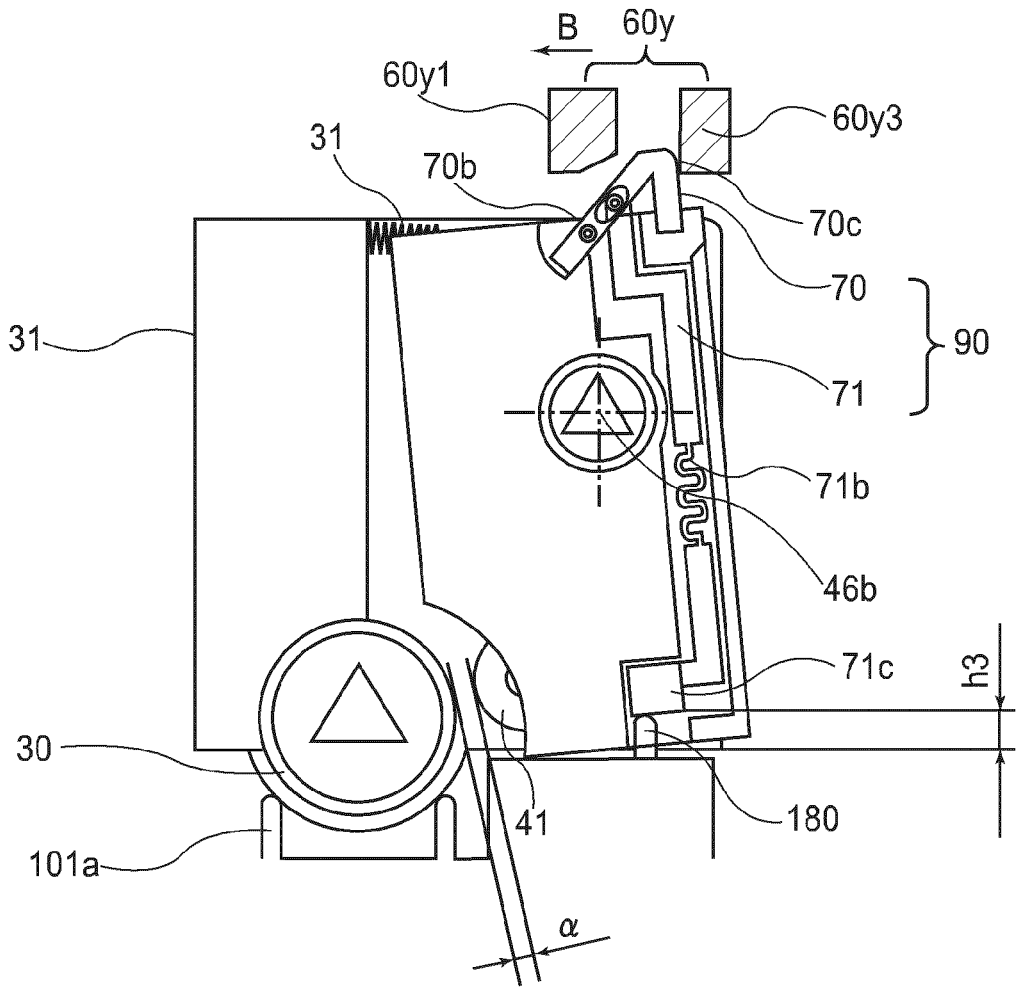
FIG. 8 is also a schematic sectional view (as seen from the side from which it receives cartridge driving force) of the process cartridge in the first embodiment of the present invention, which is being mounted into the apparatus main assembly, showing the movement of the structural components of the cartridge, which is related to the mounting of the process cartridge into the apparatus main assembly.

Referring to FIGS. 6 and 8, which are schematic side views of the cartridge 50*y*, the cover 36 of which has been removed, as seen from the side from which the cartridge 50*y* is driven, the force receiving apparatus 90 is made up of a force receiving first member 71 and a force receiving second member 70. Until the cartridge 50*y* begins to be positioned relative to the apparatus main assembly 100 in a preset manner, the force receiving second member 70 remains in its standby position, that is, the position in which the force receiving second member 70 does not project beyond the external contour of the cartridge 50*y*, as shown in FIG. 10(*a*). As the cartridge 50*y* is advanced into the apparatus main assembly 100 in the direction indicated by an arrow mark Z2 (shown in FIG. 1) by a cartridge tray 13 (which will be described later), the cartridge 50*y* is positioned in the apparatus main assembly 100 by a cartridge positioning portion 101*a* of the apparatus main assembly 100. As the cartridge 50*y* is pressed against the cartridge positioning portion 101*a*, the force receiving first member 71 is pressed upward by a projection 180 (force receiving first member pressing member) of the apparatus main assembly 100, which will be described later. That is, the force receiving first member 71 receives a first external force from the projection 180. As a result, the force receiving portion 70 is moved out of its standby position, projecting outward of the cartridge 50*y* beyond the external contour of the cartridge 50*y*, as shown in FIG. 11.

Next, referring to FIGS. 6, 7, and 9, while the cartridge 50*y* is kept in its accurate position (image forming position) in the apparatus main assembly 100 by the positioning portion 101*a*, the force receiving first member 71 is below the force receiving second member 70. The force receiving first and second members 71 and 70 are connected with each other. More specifically, the force receiving second member 70 is rotatably supported by its rotational axle 70*b*, and is provided with an elongated hole 70*a*. The top end portion (in drawings) of the force receiving first portion 71 is provided with a projection (connective pin), which is fitted in the elongated hole of the force receiving second member 70. Thus, as force is applied to the force receiving second member 70 by the force receiving first member 71, more specifically, the projection (connective pin) of the force receiving first member 71, which is in the elongated hole 70*a* of the force receiving second member 70, the force receiving second member 70 is rotationally moved about its rotational axle 70*b*.

Figure 7:
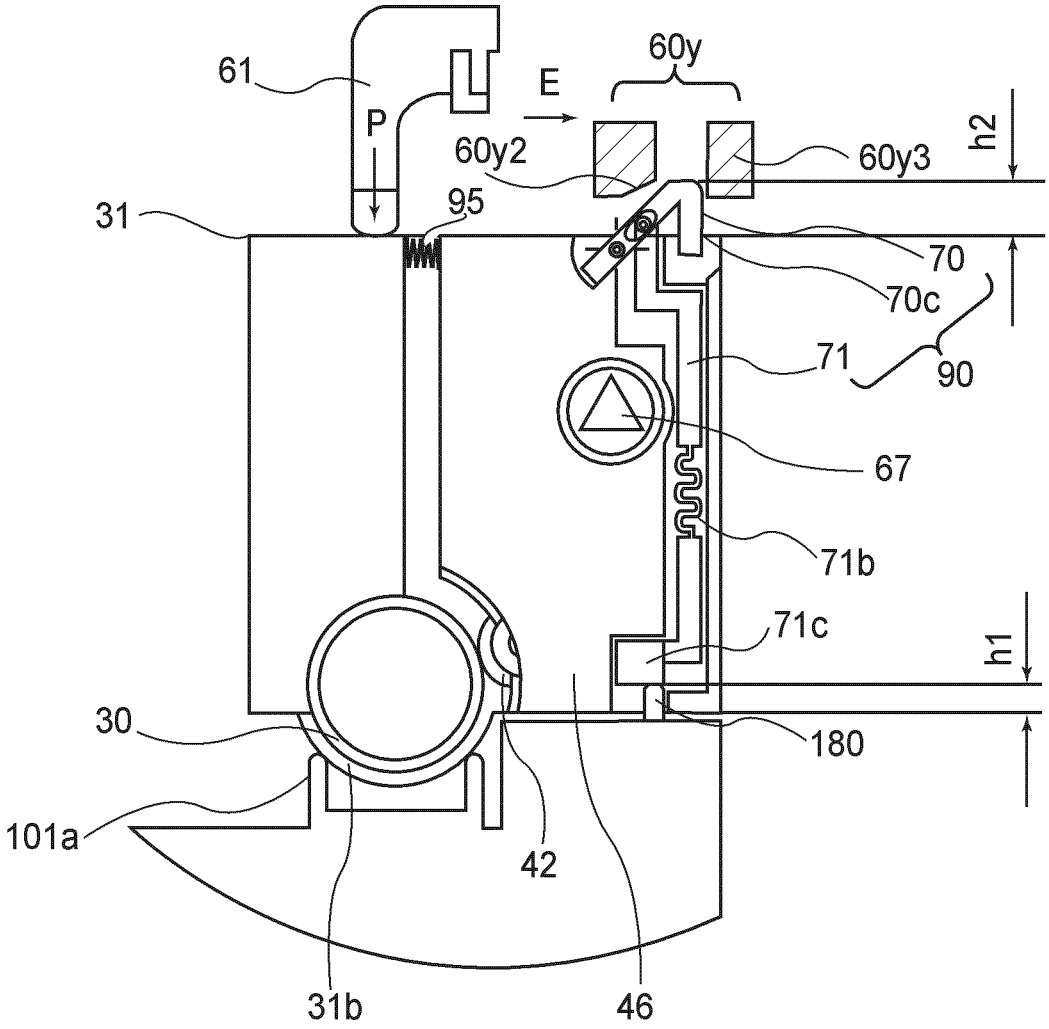
FIG. 7 is a schematic side view (as seen from the side from which it receives cartridge driving force) of the process cartridge in the first embodiment of the present invention, which is being mounted into the apparatus main assembly, showing the movement of the structural components of the cartridge, which is related to the mounting of the process cartridge into the apparatus main assembly.

Referring to FIG. 7, since the elongated hole 70*a* is located between the rotational axle 70*b* and the force catching surface 70*c*, a distance h2 by which the force receiving second member 70 moves can be made greater than a distance h1 (FIG. 7) by which the force receiving first member 71 moves, by properly setting the leverage ratio of the force receiving second member 70. Here, the distances by which the force receiving first and second members 71 and 70 move are the distances measured in terms of the vertical direction, that is, the direction parallel to the direction in which the force receiving member 71 is moved toward the force applying member 60 (which will be described later). That is, with the employment of the above described structural arrangement, the distance h2 by which the force receiving second member 70 moves can be increased without increasing the projection 180 in the distance by which it projects, making it thereby possible to reduce in size the apparatus main assembly 100 shown in FIG. 1. Incidentally, the force receiving apparatus is movably supported by the cover 46.

{Cartridge Tray of Electrophotographic Image Forming Apparatus Main Assembly}

Next, the cartridge tray 13, which is in the form of a drawer, will be described.

Figure 5:
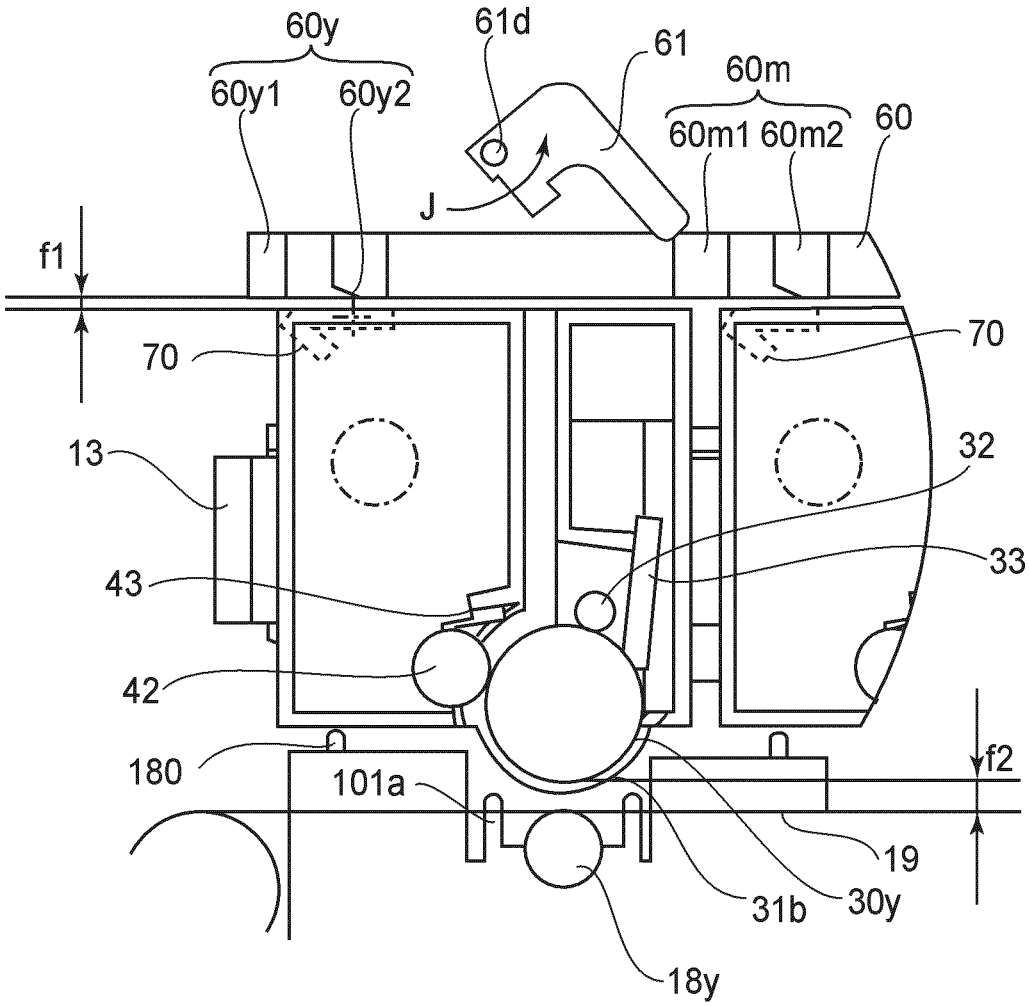
FIG. 5 is a schematic sectional view of one of the process cartridges, and its adjacencies, in the electrophotographic image forming apparatus in the first embodiment of the present invention, at a plane perpendicular to the axial line of the photosensitive drum.

Referring to FIG. 4, the cartridge tray 13 is attached to the apparatus main assembly 100 in such a manner that, in practical terms, it can be horizontally and linearly moved relative to the apparatus main assembly 100. That is, the cartridge tray 13 can be pushed into, or pulled out of, the apparatus main assembly 100 in the direction indicated by an arrow mark Z2 or Z1, respectively. The apparatus main assembly 100 is structured so that the cartridge tray 13 can be locked in the innermost position (image forming position, shown in FIG. 1, in the apparatus main assembly 100), and the outermost position (cartridge replacement position: cartridge mounting or removing position), shown in FIG. 4, which is the farthest position to which the cartridge tray 13 can be pulled out). The cartridge 50 is mounted into the cartridge tray 13 by an operator in the direction indicated by an arrow mark C, which is virtually parallel to the direction of gravity, as shown in FIG. 3. The cartridge tray 13 is structured so that as the cartridges 50 are mounted into the cartridge tray 13, the cartridges 50 become arranged in tandem, in the direction parallel to the direction in which the cartridge tray 13 is movable, with their lengthwise direction (which is parallel to axial lines of photosensitive drum 30 and the development roller 42) being perpendicular to the moving direction of the cartridge tray 13. As the cartridge 13 is pushed into the apparatus main assembly 100, the cartridges 50 in the cartridge tray 13 enter the apparatus main assembly 100, with the presence of a preset amount of gap f2 (FIG. 5) between the photosensitive drum 30 in each cartridge 50, and an intermediary transfer belt 19 located below the cartridge path. Then, as the cartridge tray 13 is moved into its innermost position in the apparatus main assembly 100, each cartridge 50 is positioned in the apparatus main assembly 100 by the cartridge positioning portion 101*a* provided in the apparatus main assembly 100 (FIGS. 5 and 7). The cartridge positioning operation will be described later in detail. A user is to close a door 12 after pushing the cartridge tray 13 all the way into the apparatus main assembly 100. Closing the door 12 ensures that each cartridge 50 is properly mounted into the apparatus main assembly 100. Therefore, in terms of operability, this structural arrangement for the apparatus main assembly 100 and cartridges 50 is superior to the structural arrangement of an electrophotographic image forming apparatus in accordance with the prior art, which requires the cartridges 50 to be individually mounted into the apparatus main assembly 100 by a user.

Next, referring to FIGS. 1, 3, 4, and 17, the operation of the cartridge tray 13 will be described. FIG. 17 does not show the cartridges 50, in order to make it easier to understand the operation of the cartridge tray 13.

The cartridge tray 13 is supported by a pair of tray supporting members 14 in such a manner that the cartridge tray 13 can be pulled out of the apparatus main assembly 100 while remaining supported by the tray supporting members 14. The tray supporting members 14 are moved by the movement of the door 12, which can be opened or closed by an operator (user). The door 12 is attached to the apparatus main assembly 100 so that it can be rotationally moved about its rotational axis 12*a*. The door 12 is rotationally movable between a position (shut position) in which it completely covers an opening 80, as shown in FIG. 1, and a position (open position) in which it fully exposes the opening 80 as shown in FIG. 3.

Figure 16:
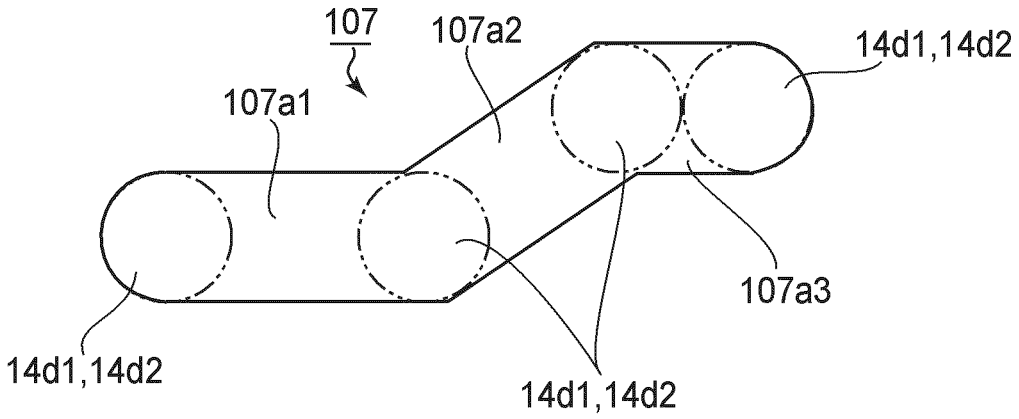
FIG. 16 is a schematic drawing of the cartridge tray guiding hole of the electrophotographic image forming apparatus in the first embodiment of the present invention.

When it is necessary to take out any cartridge or cartridge 50 in the apparatus main assembly 100, the door 12 is to be rotationally moved from the shut position to the open position. As the door 12 is rotationally moved, a pair of projections 15 (connective pins) with which the door 12 is provided moves in the clockwise direction about the rotational axis 12*a*, while moving in a pair of elongated holes 14*c*, one for one, with which the tray supporting member 14 is provided, from the bottom end of the elongated hole 14*c* toward the top end of the elongated hole 14*c*, as shown in FIG. 3. As a result, the tray supporting members 14 are moved by the projections 15 in the direction indicated by the arrow mark Z1. As the tray supporting members 14 are moved in the abovementioned direction, the projections 14*d*1 and 14*d*2, which project from each of the tray supporting members 14 are guided by the guiding holes 107 with which the apparatus main assembly 100 is provided, as shown in FIG. 4. Referring to FIG. 16, each guiding hole 107 has three sections, that is, two horizontal sections 107*a*1 and 107*a*3, and one diagonal section 107*a*2. The diagonal section 107*a*2 extends diagonally upward from the horizontal section 107*a*1 to the horizontal section 17*a*3. Therefore, as the door 12 is moved from the shut position, shown in FIG. 1, to the open position, shown in FIG. 3, the projections 14*d* 1 and 14*d* 2 are guided by the guiding hole 107, sequentially through the horizontal portion 107*a*1, diagonal portion 107*a*2, and horizontal portion 107*a*3. Thus, the tray supporting members 14 are first moved in the direction indicated by the arrow mark Z1, and then, are moved in the direction indicated by an arrow mark Y1, that is, the direction to move away from the transfer belt 19. With the tray supporting members 14 moved all the way in the direction indicated by the arrow mark Y1, the cartridge tray 13 can be pulled out of the apparatus main assembly 100 through the opening 80 in the direction indicated by the arrow mark Z1, as shown in FIG. 4. FIG. 17 is a partially cutaway perspective view of the image forming apparatus after the cartridge tray 13 has been pulled out of the apparatus main assembly 100 to its outermost position.

Next, the case in which any cartridge or cartridges 50 are mounted into the apparatus main assembly 100 will be described. Referring to FIG. 4, the cartridge tray 13 is to be pushed into the apparatus main assembly 100 in the direction of the arrow mark Z2 through the opening 80, with the door 12 kept in the open position. Thereafter, the door 12 is to be moved into the shut position as shown in FIG. 2. As the door 12 is moved, each of the projection 15 of the door 12 moves in the counterclockwise direction about the rotational axis 12*a*, while moving in the corresponding elongated hole 14*c* of the tray supporting member 14, toward the bottom end 14*c*2 of the elongated hole 14*c*, as shown in FIG. 1. Thus, the tray supporting member 14 is moved in the direction of the arrow mark Z2 by the pair of projections 15. Therefore, as the door 12 is moved into the shut position as shown in FIG. 1, the projections 14*d*1 and 14*d*2 (FIG. 4) are guided by the horizontal portion 107*a*1, the diagonal portion 107*a*2, and the horizontal portion 107*a*3, in the listed order, as shown in FIG. 16. Therefore, the tray supporting members 14 move, first, in the direction of the arrow mark Z2, and then, in the direction of the arrow mark Y2, that is, the direction to move closer to the transfer belt 19, as shown in FIG. 1.

{Positioning of Process Cartridge Relative to Electrophotographic Image Forming Apparatus Main Assembly}

Figure 18:
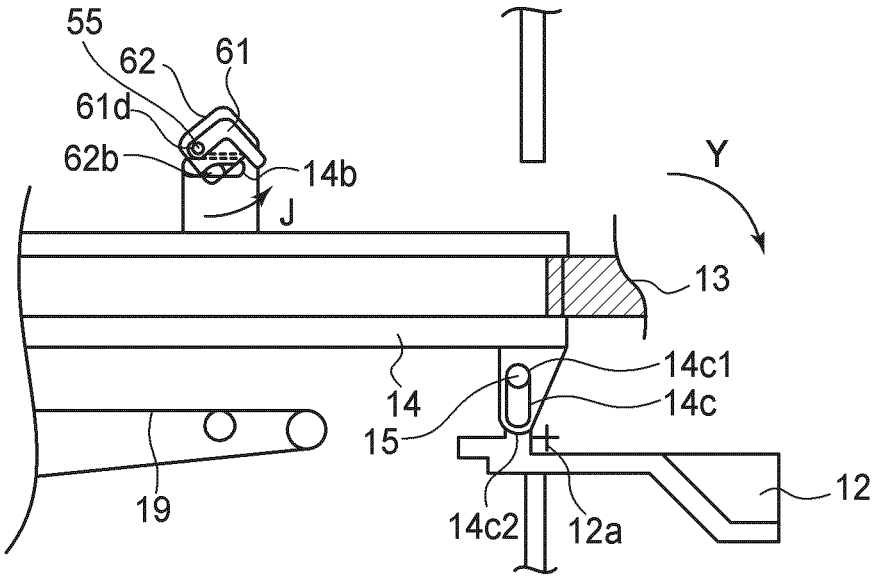
FIG. 18 is a schematic drawing of the pressing member, and the components related to the operation of the pressing member, in the first embodiment of the present invention, showing the movement of the pressing member.
Figure 18:
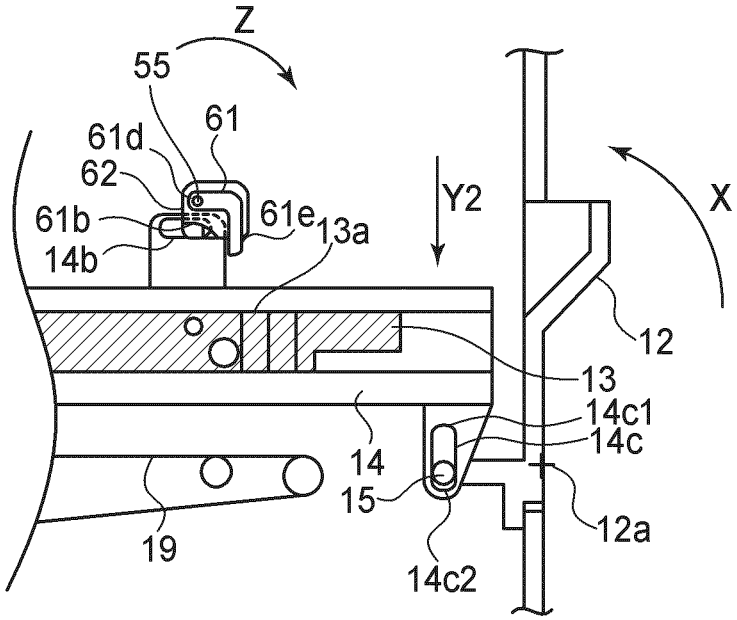

Next, referring to FIGS. 5 and 17, and the positioning of the cartridge 50 in the apparatus main assembly 100 will be described. Referring to FIG. 17, the apparatus main assembly 100 is provided with multiple pairs (four pairs in this embodiment) of cartridge positioning portions 101*a* for positioning a cartridge 50 relative to the apparatus main assembly 100. That is, each cartridge compartment of the cartridge tray 13 is provided with a pair of cartridge positioning portions 101*a*, which are located at the lengthwise ends of the corresponding compartment, one for one, in terms of the direction parallel to the lengthwise direction of the cartridge 50, in a manner to sandwich the transfer belt 19. Referring to FIGS. 18(*a*) and 18(*b*), there are pressing members 61 (61*y*, 61*m*, 61*c*, and 61*k*) above each of the tray supporting members 14. Each pressing member 61 is provided with a hole 61*d*, through which a pressing member supporting shaft 55, with which the apparatus main assembly 100 is provided, is put to rotatably support the pressing member 61.

Figure 20:
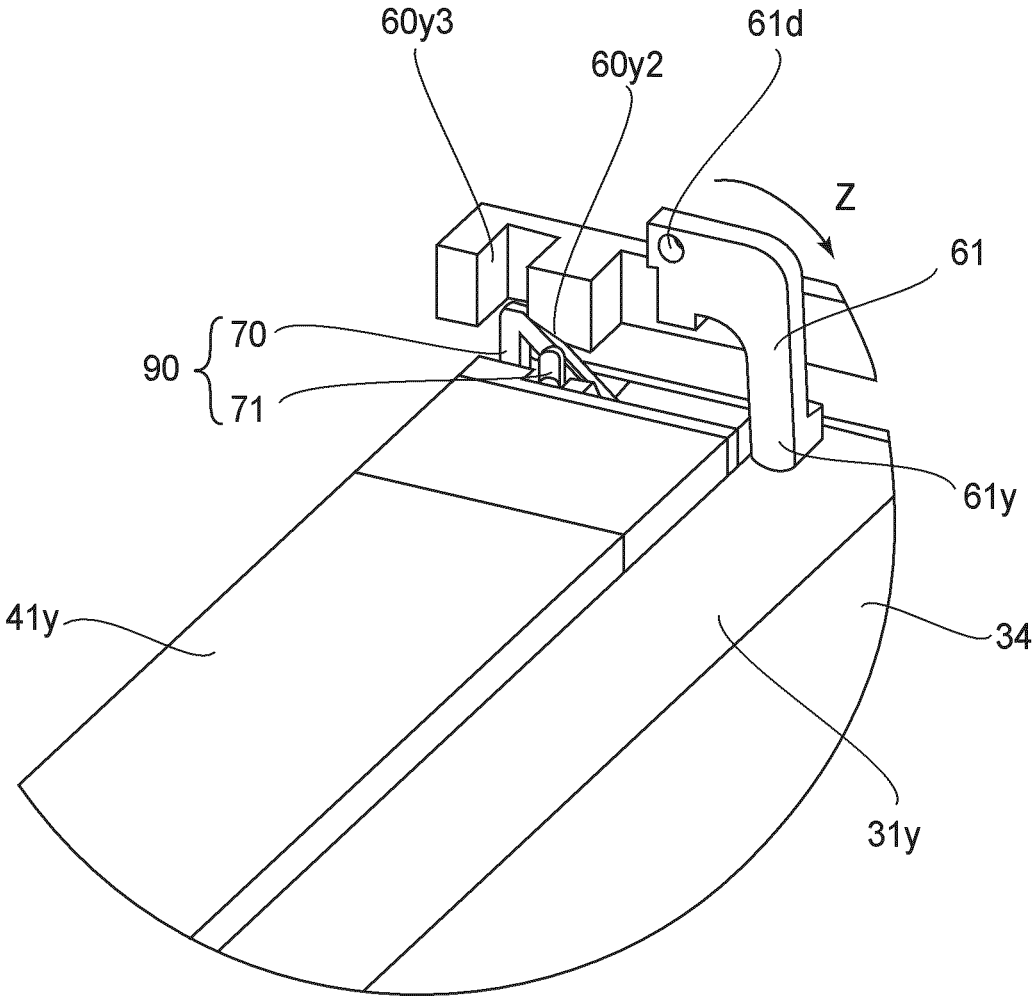
FIG. 20 is a perspective view of the force receiving apparatus of the process cartridge in the first embodiment of the present invention.

Referring again to FIGS. 18(*a*) and 18(*b*), as the door 12 is moved from the open position to the shut position (in X direction), the pressing member 61 is moved in the direction indicated by an arrow mark Z, pressing thereby on the top surface of the drum unit main frame 34 as shown in FIG. 20. Therefore, the cartridge 50*y* is pressed in the direction indicated by an arrow mark P in FIG. 7, causing the cartridge positioning portion 31*b*, with which the drum unit 31*y* is provided, to come into contact with the cartridge positioning portion 101*a* of the apparatus main assembly 100. As a result, the cartridge 50*y* is properly positioned in the apparatus main assembly 100. Similarly, the cartridges 50*m*, 50*c*, and 50*k* are properly positioned in the apparatus main assembly 100.

Further, as the cartridge 50 is made to descend toward the positioning portion 101*a* by the movement of the door 12, the projection 180 of the apparatus main assembly 100 comes into contact with the force receiving portion 71*c* of the force receiving first member 71, which is in the bottom portion of the cartridge 50. That is, the force receiving member 71 receives force from the projection 180, from the bottom side of the cartridge 50. In comparison, when the door 12 is moved from the shut position to the open position (Y direction), the pressing member 61 moves in the direction indicated by an arrow mark J. As a result, the pressing member 61 separates from the top surface of the drum unit main frame 34 as shown in FIG. 5.

{Development Roller Separating Mechanism of Electrophotographic Image Forming Apparatus Main Assembly}

Next, the operation of the force applying first portion 60 will be described.

Figure 19:
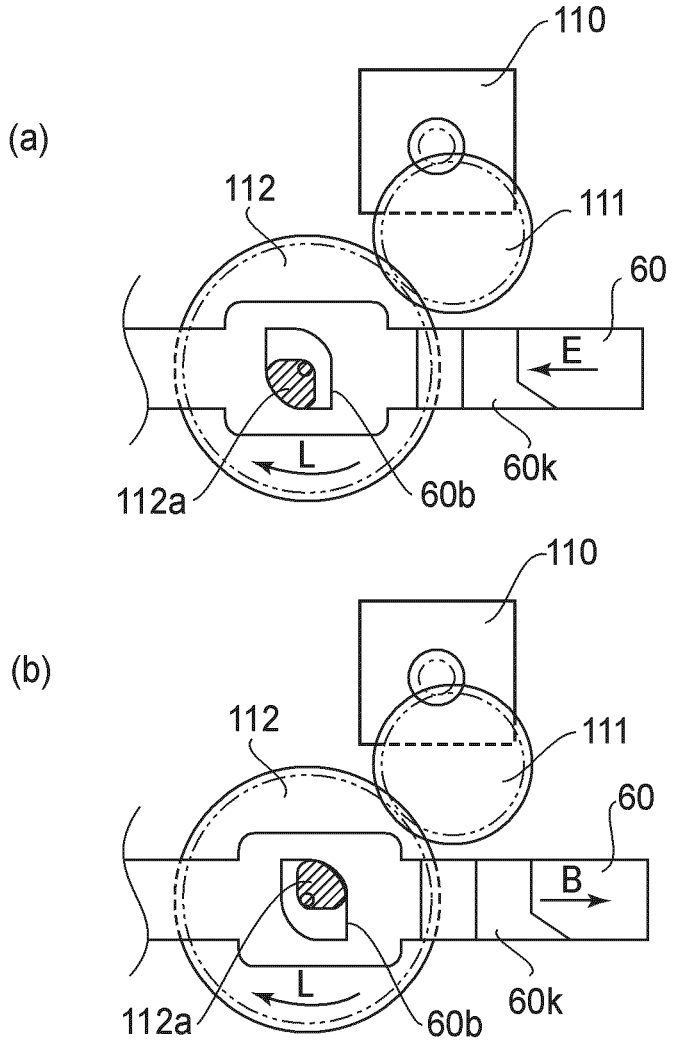
FIG. 19 is a schematic drawing of the force applying first member, and the components related to the operation of the force applying first member, in the first embodiment of the present invention, showing the operation of the force applying first member.

Referring to FIGS. 1, 3 and 19, in terms of the vertical direction of the apparatus main assembly 100, the force applying member 60 is positioned so that after the proper positioning of the cartridge 50, the force applying member 60 is above the cartridge 50. In terms of the axial line of the photosensitive drum 30, the force applying member 60 is positioned so that it is enabled to come into contact with the force receiving second member 70 which is at the corresponding lengthwise ends of the cartridge 50.

A driving force is transmitted from a motor 110 (mechanical power source) with which the apparatus main assembly 100 is provided, to a gear 112 through a gear 111. As the driving force is transmitted to the gear 112, the gear 112 rotates in the direction indicated by an arrow mark L, rotating thereby the cam portion 112*a*, which is integral with the gear 112, in the arrow L direction. The cam portion 112*a* is in contact with the moving force receiving portion 60*b*, with which the force applying member 60 is provided. Therefore, as the cam portion 112*a* rotates, the moving force receiving member 60 is moved in the direction indicated by an arrow mark E or B.

Referring to FIG. 19(*a*), as the force applying member 60 moves in the direction indicated by the arrow mark E, a rib 60*y* of the force applying member 60 separates from the force receiving second member 70, as shown in FIG. 7, allowing thereby the development roller 42 to come into contact with the photosensitive drum 30. This position of the development unit 41, which allows the development roller 42 to remain in contact with the photosensitive drum 30, will be referred to as the contact position.

Referring to FIG. 19(*b*), as the force applying member 60 is moved in the direction indicated by the arrow mark B, the rib 60*y* comes into contact with the force receiving second member 70, subjecting the force receiving second member 70 to external force (second external force) through the rib 60*y*. Therefore, the development unit 41 is rotated (rotationally moved) about the cylindrical portion 46*b* (rotational axle), separating thereby the development roller 42 from the photosensitive drum 30. This position of the development unit 41, which keeps the development roller 42 separated from the photosensitive drum 30, will be referred to as the separation position.

Similarly, the force applying member 60 is positioned above the path of the cartridge 50, through which the cartridge 50 is moved into the apparatus main assembly 100 by the cartridge tray 13. The force receiving second member 70 is attached to the cartridge 50 in such a manner that until the cartridge 50 is moved into the apparatus main assembly 100, the force receiving second member 70 remains in its standby position (FIG. 5). Therefore, the force applying member 60 can be positioned significantly closer to the cartridge path, without allowing the force applying member 60 and the cartridge 50 to interfere with each other during the mounting of the cartridge 50, compared to the force applying member of an image forming apparatus in accordance with the prior art, making it possible to minimize wasted space, making it thereby possible to significantly reduce the cartridge 50*y* in terms of its dimension in terms of its lengthwise direction (axial direction of photosensitive drum 30) as well as the vertical direction of the apparatus main assembly 100. The detailed description of the force applying member 60 will be given later.

{Description of Mounting of Process Cartridge into Electrophotographic Image Forming Apparatus Main Assembly, and Operation of Force Receiving Apparatus}

Next, the operational sequence from the beginning of the mounting of the cartridge 50 into the apparatus main assembly 100, to the separation of the development roller 42 from the photosensitive drum 30, will be described.

Referring to FIG. 4, after the cartridge tray 13 is pulled out of the apparatus main assembly 100 to its outermost position, each cartridge 50 can be mounted into, or removed from, the cartridge tray 13 in the vertical direction, which is indicated by the arrow mark C.

After the mounting of the cartridge(s) 50 into the cartridge tray 13, the cartridge tray 13 is to be moved into the apparatus main assembly 100 in the direction indicated by the arrow Z2, through the opening 80. That is, in this embodiment, each cartridge 50 is horizontally moved into the apparatus main assembly 100, from the direction which intersects (roughly perpendicular) to the axial line of the photosensitive drum 30.

Referring to FIG. 3, the cartridge 50*y* is mounted in the downstream end of the cartridge tray 13 in terms of the direction in which the cartridge tray 13 is moved into the apparatus main assembly 100. That is, the cartridge 50*y* moves below the ribs 60*k* 60*c*, and 60*m* of the force applying member 60 from upstream to downstream.

If the apparatus main assembly 100 and cartridge 50*y* are structured so that the force receiving second member 70 remains projecting when the cartridge 50*y* is moved into the apparatus main assembly 100, the pressing member 61 and the force applying member 60 must be positioned significantly higher than they are positioned in this embodiment. In this embodiment, however, the apparatus main assembly 100 and the cartridge 50*y* are structured so that the force receiving second member 70 remains in the above described standby position when the cartridge 50*y* is moved into the apparatus main assembly 100. Therefore, the pressing member 61 and the force applying member 60 can be positioned as closely as possible, without taking into consideration the distance by which the force receiving second member 70 projects beyond the external contour of the cartridge 50*y*. In other words, the pressing member 61 and the force applying member 60 can be positioned significantly closer to the path of the cartridge 50*y*, making it possible to reduce the dimension of the cartridge 50*y* in the direction parallel to the vertical direction of the apparatus main assembly 100, compared to the counterparts of a process cartridge in accordance with the prior art. Further, referring to FIG. 20, in terms of the direction parallel to the axial line of the drum 30, the force receiving apparatus 90, the pressing member 61, and the force applying member 60 overlap, making it possible to reduce thereby the dimension of the cartridge 50*y* in the lengthwise direction of the cartridge 50*y*.

Next, referring to FIG. 5, the image forming apparatus in this embodiment is structured to ensure that when the cartridge tray 13 is moved into the apparatus main assembly 100, there remains a gap f1 between the force applying member 60 and the force receiving second member 70, and a gap f2 between photosensitive drum 30 and the transfer belt 19. Therefore, the cartridge 50 and the apparatus main assembly 100 do not interfere with each other when the cartridge 50 is moved into the apparatus main assembly 100.

After the cartridge tray 13 is pushed all the way into the apparatus main assembly 100, the door 12 is to be moved into the shut position as shown in FIGS. 1 and 18(*b*). As the door 12 is moved into the shut position, the tray supporting members 14 are moved toward the transfer belt 19 (the direction indicated by arrow mark Y2). Hereafter, the vertical component of this movement of the tray supporting members 14 in the direction indicated by the arrow mark Y2 will be referred to as a distance f2. As the tray supporting members 14 are moved in the direction indicated by the arrow mark Y2, the cartridges 50 are moved toward the transfer belt 19 by the movement of the tray supporting members 14, causing thereby the peripheral surface of the photosensitive drum 30 in each cartridge 50 to come into contact with the surface of the transfer belt 19. By the time the peripheral surface of the photosensitive drum 30 comes into contact with the surface of the transfer belt 19, the gap f1 between the force receiving apparatus 90 and the force applying member 60 widens to the sum of the gaps f1 and f2, as shown in FIG. 5.

Further, as the door 12 is moved into the shut position, the pressing member 61 is moved by the movement of the door 12, pressing thereby on the top surface of the drum unit main frame 34. Therefore, the cartridge positioning portion 31*b* of each cartridge 50 is placed in contact with the cartridge positioning portion 101*a* of the apparatus main assembly 100. Consequently, each cartridge 50 is properly positioned relative to the apparatus main assembly 100, as shown in FIG. 7.

Further, a shaft 36*d*, shown in FIG. 10, with which the cover 36 of each cartridge 50 is provided, engages with the cartridge rotation stopping portion 13*a* (FIG. 17), with which the cartridge tray 13 is provided. Therefore, the cartridge 50 is prevented from moving further in the direction indicated by an arrow mark a in FIG. 1, in the apparatus main assembly 100.

Next, referring to FIG. 6, the home position of the force applying member 60 in this embodiment is made to be where the force applying member 60 keeps the development roller 42 separated from the photosensitive drum 30. This is for the following reason. That is, while the image forming apparatus is not used for image formation after the mounting of the cartridges 50, each cartridge 50 remains in the state shown in FIG. 8. That is, the force applying member 60 has moved in the direction indicated by the arrow mark B, and the force receiving second member 70 has been moved by the rib 60*y* as far as it can be moved. While the cartridge 50 is in this state, the photosensitive drum 30 and the development roller 42 remain separated from each other. It is in this state, shown in FIG. 8, in which the photosensitive drum 30 and development roller 42 remain separated from each other, that the cartridge 50 is removed from the apparatus main assembly 100. Thus, when the cartridge 50 is mounted into the apparatus main assembly 100 next time, the force applying member 60 is in the position shown in FIG. 8. Therefore, as the cartridge 50 is mounted, the force receiving second member 70 comes into contact with the rib 60*y*, because the force receiving second member 70 is out of its standby position, as shown in FIG. 6. Thus, the force receiving first portion 71 is provided with an elastic portion 71*b*, which is formed as an integral part of the force receiving first portion 71, as shown in FIG. 6. Therefore, as the contact between the force receiving second member 70 and the rib 60*y* begins to interfere with the inward movement of the cartridge 50, the elastic portion 71*b* gives in (is compressed), preventing thereby the force receiving apparatus 90 from being damaged.

As the force applying member 60, which is in the state shown in FIG. 6, is moved in the direction indicated by an arrow mark E as shown in FIG. 7, the force receiving second member 70 projects outward farther from the cartridge 50*y*, entering thereby the path of the rib 60*y*. This position of the force receiving second member 70, that is, the position in which the force receiving second member 70 is in the path of the rib 60*y*, will be referred to as the outermost position (active position). That is, when the force receiving second member 70 is in its outermost position, the distance of the projection of the force receiving second member 70 is greater than that when the force receiving second member 70 is in the abovementioned standby position, which is obvious. In order for the force receiving second member 70 to engage with the force applying member 60, the distance of the projection of the force receiving second member 70 at the outermost position must be greater than the sum of the gaps f1 and f2. Further, the action of the force applying member 60 is triggered in a period between the completion of the mounting of the cartridges 50 into the apparatus main assembly 100 and the starting of an image forming operation.

Next, referring to FIG. 8, as the force applying member 60 is moved in the direction indicated by the arrow mark B, the lateral surface 70*c*, which is the force catching surface of the force receiving second member 70, receives an external force (second external force) through the rib 60*y*3, since the force receiving second member 70 (lateral surface 70*c*) is in the path of the force applying member 60. Therefore, the development unit 41 is rotationally moved about its rotational axis 46*b* (shaft), causing thereby the development roller 42 to separate by a gap a from the photosensitive drum 30. It is in its outermost position that the force receiving second member 70 receives the external force (second external force) from the force applying member 60. Therefore, this structural arrangement is greater in the distance between the force applying member 60 and the rotational axis 46*b* of the development unit 41 than a structural arrangement which moves the force applying member toward the process cartridge to separate the development roller from the photosensitive drum. Therefore, the employment of this structural arrangement makes it possible to reduce the amount of torque necessary to separate the development roller 42 from the photosensitive drum 30.

In this embodiment, the elastic portion 71*b* is an integral part of the force receiving first member 71. However, as long as it is enabled to absorb the force applied to the force receiving first member 70 by the abovementioned change in the position of the cartridge 50, it may be formed as a part of another component, or as an independent component. For example, the force applied to the force receiving first member 71 by the change in the position of the cartridge 50 may be absorbed by placing an absorbing member independent from the force receiving second and first members 70 and 71, between the force receiving second and first members 70 and 71, or by forming the force receiving second member of an elastic material so that the above described force can be absorbed by the deformation of the force receiving second member 71 itself.

Before the starting of an image forming operation, the force applying member 60 is moved in the direction indicated by the arrow mark E to place the development roller 42 in contact with the photosensitive drum 30. As the force applying member 60 is moved in the abovementioned direction, the force receiving second member 70 stops receiving force from the rib 60*y*, as shown in FIG. 7. Therefore, the development roller 42 is placed in contact with the photosensitive drum 30 by the resiliency of the compression springs 95 provided between the development unit 41 and drum unit 31, readying thereby the process cartridge 50 for image formation. It is before the development roller 42 comes into contact with the photosensitive drum 30 that the photosensitive drum 30 begins to be rotated, and the development roller 42 begins to be rotated, by the driving force which the cartridge 50 receives from the apparatus main assembly 100 through the coupling portion 67. This is for the following reason. That is, referring to FIG. 10(*a*), the coupling portion 67 is made coaxial with the cylindrical portion 46*b* so that even when the development unit 41 moves about the cylindrical portion 46*b*, the coupling portion 67 does not change in position. That is, in this embodiment, it is before the development roller 42 is placed in contact with the photosensitive drum 30 that the development roller 42 and the photosensitive drum 30 begin to be rotated. This arrangement makes it possible to minimize the difference in peripheral velocity between the photosensitive drum 30 and the development roller 42 when the development roller 42 comes into contact with the photosensitive drum 30. Therefore, it can minimize the amount of the wear that occurs to the photosensitive drum 30 and the development roller 42 when the two come into contact with each other. After the completion of the image forming operation, the development roller 42 is separated from the photosensitive drum 30 by moving the force applying member 60 in the direction indicated by the arrow mark B as described above. It is after the separation of the development roller 42 from the photosensitive drum 30 that the development roller 42 and photosensitive drum 30 are stopped. Thus, this arrangement minimizes the difference in the peripheral velocity between the development roller 42 and the photosensitive drum 30, which occurs when the two become separated. Therefore, it minimizes the amount by which the development roller 42 and the photosensitive drum 30 wear when they are separated from each other. Consequently, this arrangement improves an image forming apparatus in image quality.

Next, the operation for removing the cartridge 50 from the apparatus main assembly 100 will be described.

First, the door 12 is to be moved from its shut position to the open position. As the door 12 is moved, the tray supporting members 14 are raised in the direction to separate from the transfer belt 19 as shown in FIGS. 3 and 4. Therefore, the cartridges 50 are moved upward, causing the photosensitive drum 30 in each cartridge 50 to separate from the transfer belt 19. Further, the pressing member 61 is rotated in the direction indicated by the arrow mark J in FIG. 5, being separated from the drum unit 31, as described above. Thus, the force receiving first member 71 separates from the projection 180, being thereby deprived of the force to keep the force receiving second member 70 projecting beyond the external contour of the development unit 41.

Figure 21:
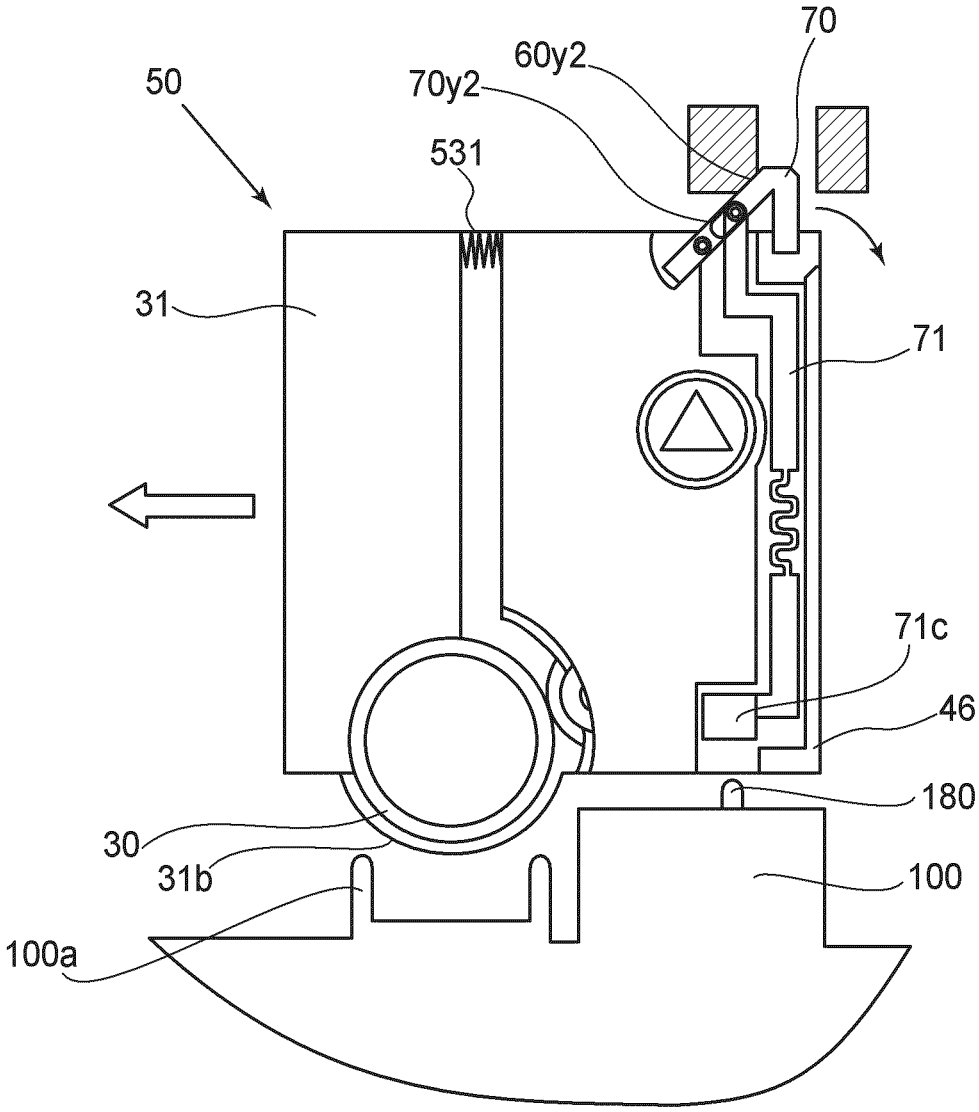
FIG. 21 is a schematic drawing of the process cartridge in the first embodiment of the present invention, the force receiving second member of which has been just been moved by the force applying second member of the cartridge.

As for the force receiving second member 70, its slant surface 70*y*2 comes into contact with the slant surface 60*y*2 of the force applying 60, as shown in FIG. 21. Thus, the force receiving second member 70 is rotationally moved about its rotational axis 70*a*, back into its standby position (inaction position), by the component of the force to which the slant surface 70*y*2 is subjected as the cartridge 50 (cartridge tray 13) is pulled out. Incidentally, a spring may be employed, as in another embodiment of the present invention, as the means for generating the force for returning the force receiving second member into its standby position. That is, the first embodiment, in which the abovementioned spring is not employed, was presented as the embodiment which is smallest in the components count.

As described above, in this embodiment, the apparatus main assembly 100 and the cartridge 50 are structured so that as the door 12 is moved into its shut position after the cartridge 50 is mounted into the apparatus main assembly 100, the force receiving second member 70 for moving the development unit 41 projects beyond the outward surface of the development unit 41. Therefore, the cartridge 50 in this embodiment is significantly smaller in height than a cartridge (50) in accordance with the prior art. Further, the force receiving second member 70 remains in its standby position while the cartridge 50 is mounted. Therefore, the space necessary, in the apparatus main assembly 100 in this embodiment, for the movement of the cartridge(s) 50 does not need to be as large as that in the main assembly of an image forming apparatus in accordance with the prior art. That is, the present invention makes it possible to reduce the opening 80 in size, and also, makes it possible to place the force applying member 60 significantly closer to the path of the cartridge 50 than the prior art, making it thereby possible to reduce the apparatus main assembly 100 in vertical dimension. Further, the force receiving apparatus 90, the pressing member 61, and the force applying member 60 are positioned so that they overlap in terms of the direction parallel to the axial line of the drum, as shown in FIG. 20, making it possible to reduce the cartridge in its lengthwise dimension.

Further, when the cartridge 50 is handled by a user, or is transported alone, the force receiving second member 70 remains in its standby position, being therefore unlikely to be damaged.

In this embodiment, the apparatus main assembly 100 is structured so that its projection 180 is below the path of the cartridge 50. However, as long as the projection 180 comes into contact with the force receiving first member 71 while the cartridge 50 is mounted into the apparatus main assembly 100, it does not matter where the projection 180 is positioned. Moreover, the shape of the projection 180 is optional, as long as the projection 180 is enabled to move the force receiving portion 71*c* by coming into contact with the force receiving portion 71*c*. In other words, the force receiving portion 71*c* may be a stationary projection which projects from the cover 46. However, if the force receiving portion 71*c* is made stationary, the force receiving portion 71*c* must be adjusted in height to prevent the force receiving portion 71*c* from coming into contact with the apparatus main assembly 100 while the cartridge 50*y* is mounted into the apparatus main assembly 100.

Embodiment 2

Figure 12:
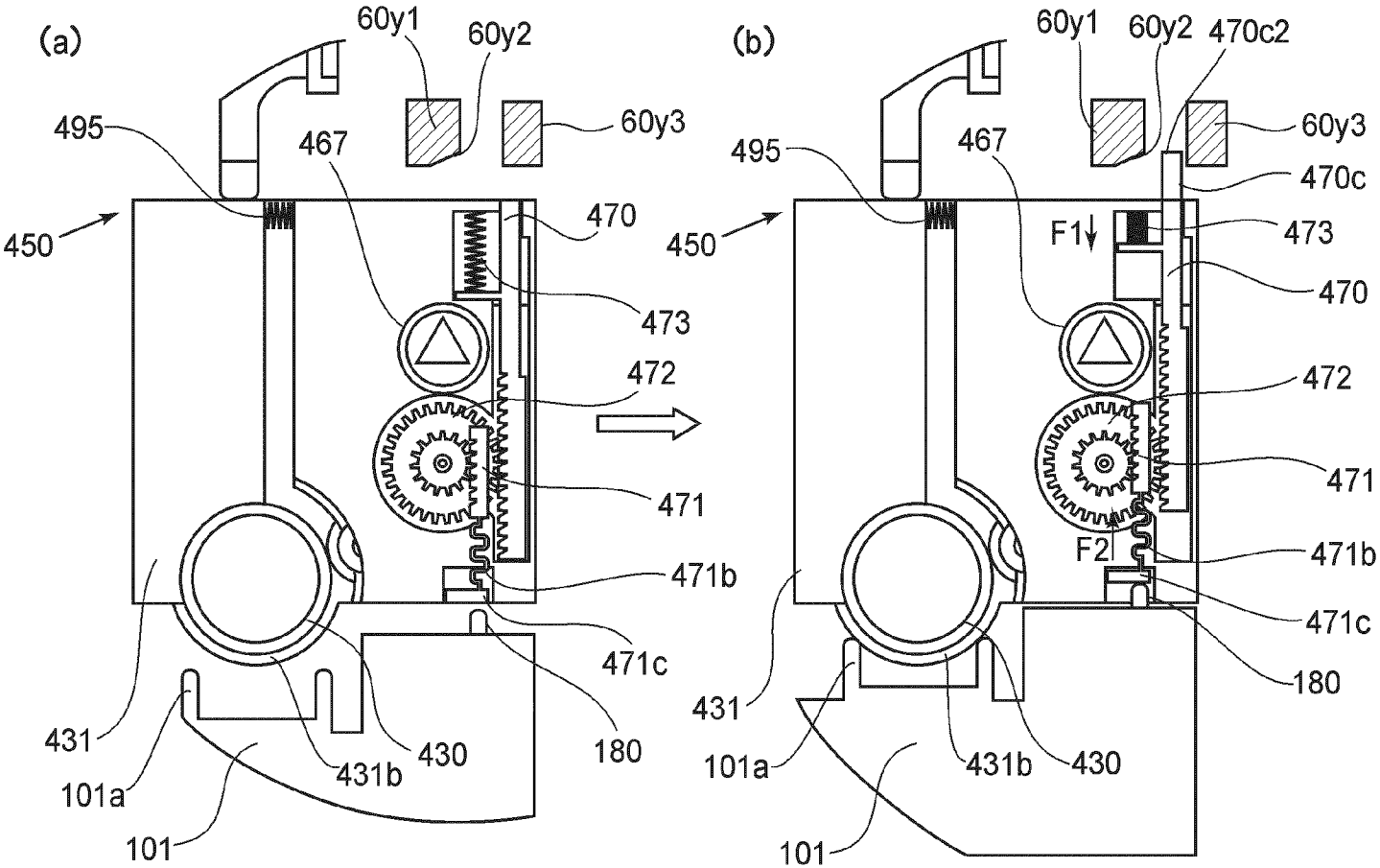
FIG. 12 is a schematic drawing of the process cartridge in the second embodiment of the process cartridge, showing the movement of the structural components of the cartridge.
Figure 13:
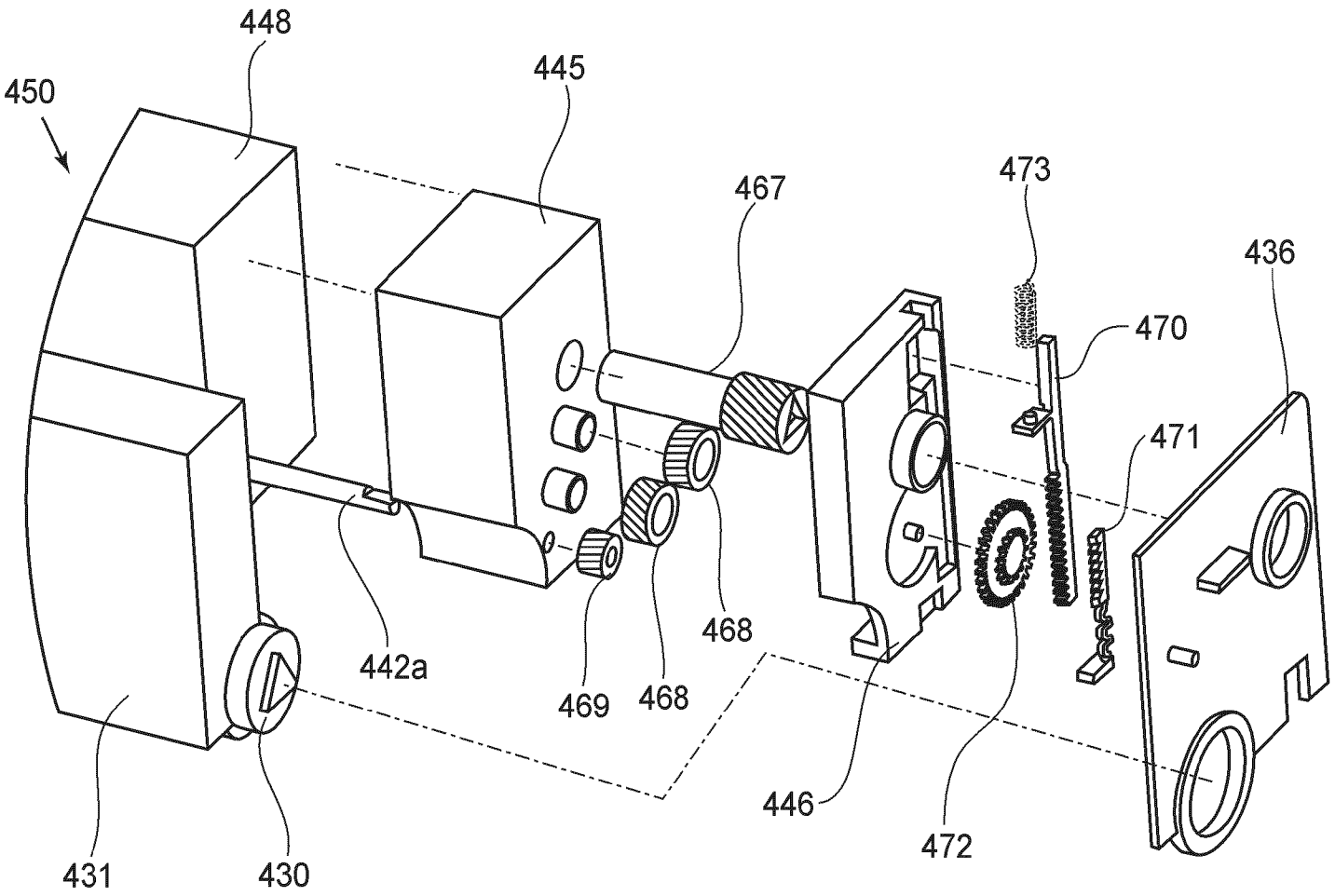
FIG. 13 is an exploded perspective view of the process cartridge in the second embodiment of the present invention.

Next, referring to FIGS. 12 and 13, another preferred embodiment of the present invention will be described. In this embodiment, the cartridge 50 is provided with a first lever 471, a second lever 470, and a gear 472. The first lever 471 has a force receiving first portion 471*c*. The second lever 470 has a force receiving second portion 470*c*, and meshes with the gear 472. This structural arrangement can move the second lever 470 by a greater distance than the distance by which the first lever 471 is moved.

The gear 472 is a step gear made up of a portion (first portion) which engages with the first lever 471 and is n1 in tooth count, and a portion (second portion) which engages with the second lever 470 and is n2 in tooth count. Thus, it is possible to amplify the distance by which the first level 471 is moved by making the tooth count n2 of the second portion of the gear 472 greater than the tooth count n1 of the first portion of the gear 472 (n2>n1). To concretely described the operation of the force receiving apparatus in this embodiment, referring to FIG. 12(*a*), while the cartridge 50 is inserted into the apparatus main assembly 100, the second lever 470 remains within the cartridge 50. Then, when the cartridge 50 is properly positioned relative to the apparatus main assembly 100 by the cartridge positioning portion 101*a*, the force receiving first portion 471*c* begins to receive external force (first external force) from the projection 180, being thereby moved upward as indicated by an arrow mark F2. As the force receiving first portion 471*c* moves upward as indicated by the arrow mark F2, the gear 472 is rotated, and this rotation of the gear 472 causes the second lever 470 to move upward. Thus, immediately after the cartridge 50 is properly positioned by the cartridge positioning portion 101*a*, the second lever 470 is in its outermost position as shown in FIG. 12(*b*). When the second lever 470 is in its outermost position, the force receiving portion 470*c* of the lever 470 receives the external force (second external force) from the rib 60*y*3 in the same manner as the force receiving second portion 70*c* of the force receiving second member 70 receives external force from the rib 60*y*3 in the first embodiment.

Further, in this structural arrangement, a coil spring 473 is provided to ensure that the second lever 470 always returns to its standby position. The reason therefor is as follows: It is assumed that from the standpoint of apparatus design, it is difficult to ensure that the component of the force which the slant surface 60*y*1 receives is large enough to return the force receiving portion 470*c* to its original position (for example, if the amount of the force necessary to pull cartridges (cartridge tray) increases). In other words, the provision of the coil spring 473 is not mandatory, as it is not in the first embodiment.

This embodiment, however, will be described with reference to a case where the coil spring 473 is provided. In this case, unless the resiliency of the coil spring 473 is smaller than the resilience of the elastic portion 471*b*, which is an integral part of the lever 471, the force receiving first member 470 is not allowed to move. Therefore, all that is necessary is to set the relationship between a force F1 which is generated by the coil spring 473, and a force F2 which is generated by the elastic member 471*b*, to be F1<F2.

In this embodiment, the cartridge 450 is designed to be assembled in the following manner: First, the gear 472 is rotatably supported by the cover 446, which is firmly attached to the bearing unit 445, and then, the second lever 470 and first lever 471 are attached so that the two levers mesh with the corresponding portions of the gear 472. The shape of the apparatus main assembly in this embodiment is the same as that of the apparatus main assembly in the first embodiment. Therefore, the force receiving portion which is necessary to place the development roller in contact with the photosensitive drum, or separate the development roller from the photosensitive drum, is the tip 470*c* of the second lever 470. Otherwise, this embodiment is the same as the first embodiment.

As described above, the force receiving apparatus in this embodiment is the same in effectiveness as that in the first embodiment. In this embodiment, however, the distance by which the second lever is moved can be easily changed by changing the gear ratio between the first and second portions of the gear 472.

Also in this embodiment, when the cartridge tray is pulled out, the force receiving member 470 comes into contact with the slant surface 60*y*2. Then, as the cartridge tray is pulled out further, the force receiving second member 470 is pushed back into the development unit, and stored therein, by being moved in the direction indicated by an arrow mark F2 by the slanted surface 60*y*2. Therefore, the provision of the return spring 473 is not mandatory.

Embodiment 3

Next, referring to FIGS. 14 and 15, the third embodiment of the present invention will be described with reference to a case where the force receiving first member belongs to a drum unit 531. First, the method for assembling the cartridge in this embodiment will be described. The cartridge in this embodiment is designed so that a force receiving first member 571 belongs to a drum unit 531. A force receiving second member 570 and a connective rod 574 are attached to a cover 546. Then, the cover 536 is joined with a bearing member 545. Lastly, the development unit 541 and drum unit 531 are connected by the cover 536 to complete the cartridge 550.

Figure 14:
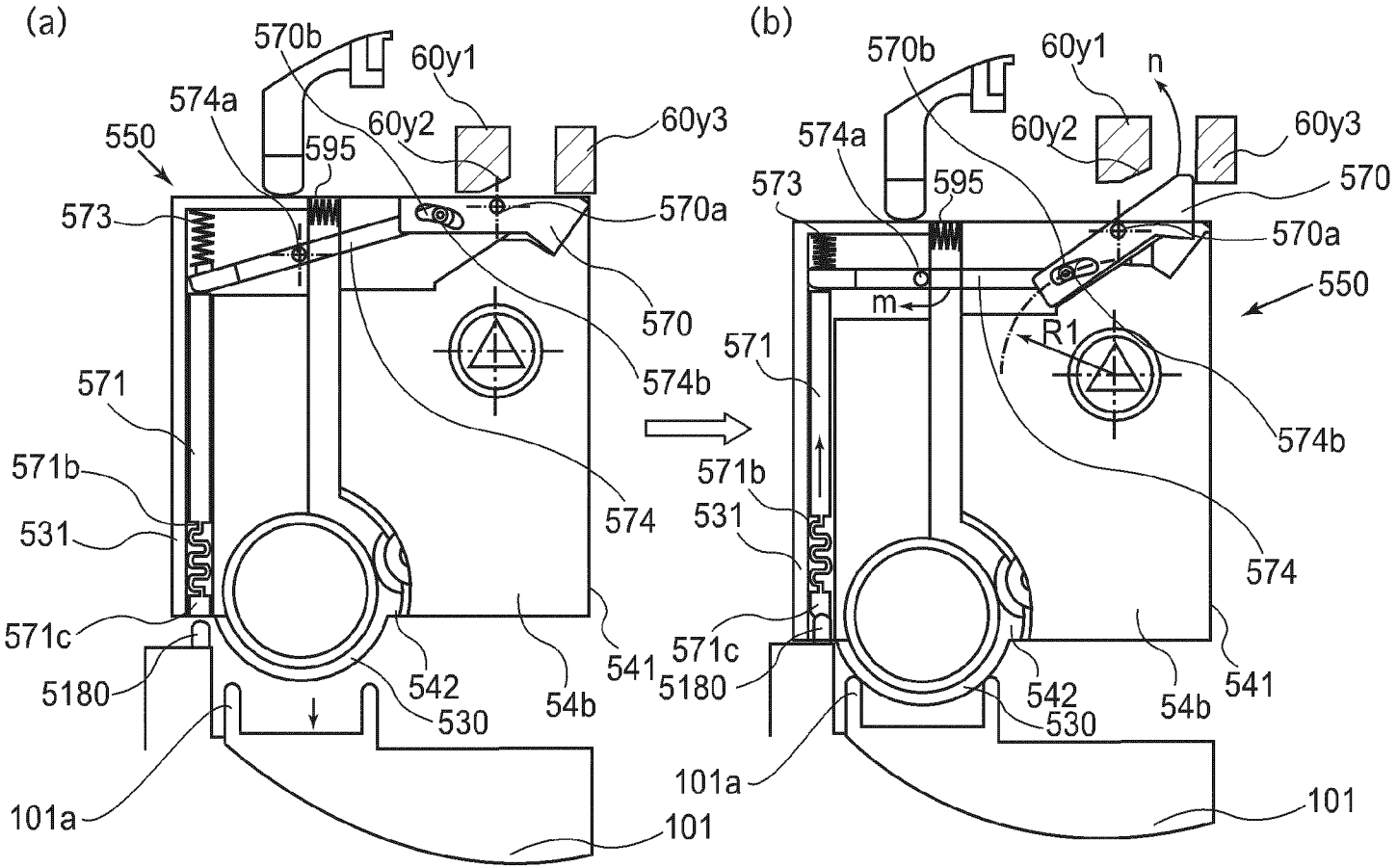
FIG. 14 is a schematic drawing of the process cartridge in the third embodiment of the process cartridge, showing the movement of the structural components of the cartridge, which is related to the mounting of the process cartridge into the apparatus main assembly.
Figure 15:
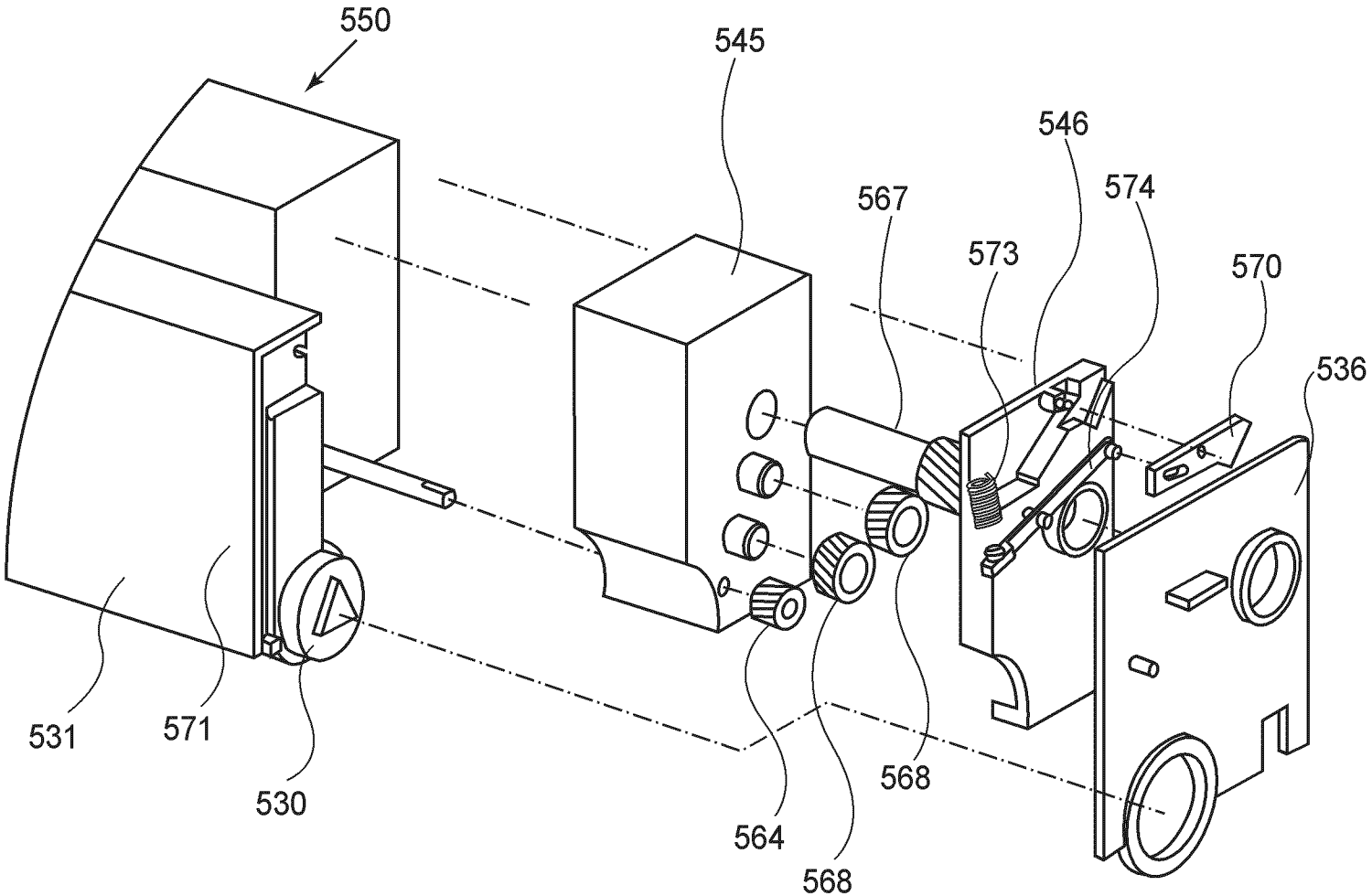
FIG. 15 is an exploded perspective view of the process cartridge in the third embodiment of the present invention.

To describe in more detail the cartridge 550 in this embodiment with reference to FIGS. 14 and 15, first, referring to FIG. 14, a projection 5180 of the apparatus main assembly is located so that it opposes the drum unit. Thus, the force receiving first member 571 is placed in the drum unit 531.

The drum unit is provided with the force receiving first member 571, which has a force receiving first portion 571*c* and is movable. Further, the drum unit is provided with a rod in the form of the force receiving first portion 571 and a connective rod 574. The connective rod 574 is rotationally movable about the rotational axis 574*a* while remaining in contact with the rod 571. The development unit is provided with a force receiving second member 570, which has an elongated hole 570*b* and is rotationally movable about a rotational axis 570*a*. Further, the opposite lengthwise end of the connective rod 574 from the rod 571 is provided with a projection (connective pin) which fits in the elongated hole of the force receiving second member 570.

When the cartridge 550 is properly positioned relative to the apparatus main assembly 101 by the cartridge positioning portion 101*a*, the force receiving first portion 571*c* begins to receive external force (first external force) from the projection 5180. Therefore, the force receiving first member 571 begins to be moved in the direction indicated by an arrow mark positioned inside member 571 as shown in FIG. 14(*b*), causing the connective rod 574 to rotationally move in the direction (clockwise direction) indicated by an arrow mark m. Thus, the force receiving second member 570 is rotationally moved about the rotational axis 570*a* in the direction to move the opposite end portion of the force receiving second member 570 from the elongated hole 570*b*, arcuately upward, as indicated by an arrow mark n. Since the curvature of the elongated hole 570*b* is such that while the development roller is not in contact with the photosensitive drum, the center of the curvature of the elongated hole 570*b* coincides with the rotational axis of the development unit 541. Therefore, while the development unit 541 is separated from the drum unit 531, the connective rod 574 is subjected to no load. Also in this embodiment, a return spring (573) is provided. However, the return spring 573 may be eliminated by a design change.

Also in this embodiment, the distance by which the force receiving second member is moved can be made greater than the distance by which the force receiving first member is moved, by properly selecting the leverage ratio of the connective rod.

Further, in this embodiment, when the cartridge tray is pulled out, the force receiving second member 570 comes into contact with the slant surface 60*y*2 as does the force receiving first member 70 in the first embodiment. Then, as the cartridge tray is pulled out further, the force receiving second member 570 is pushed back into the development unit 541 to be stored therein, by being moved in the direction opposite from the direction indicated by the arrow mark n. Therefore, the provision of the return spring 573 is not mandatory.

According to the present invention, it is possible to reduce in size a process cartridge, the electrophotographic photosensitive drum, and the development roller, which can be placed in contact with, or separated from, the electrophotographic photosensitive drum. It is also possible to reduce in size an electrophotographic image forming apparatus which employs the abovementioned process cartridge. Further, it is possible to structure an electrophotographic image forming apparatus so that its force receiving apparatus for separating the development roller from the electrophotographic photosensitive drum is unlikely to be damaged while the abovementioned process is handled by a user, or is transported alone.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 172742/2007 and 162311/2008 filed Jun. 29, 2007 and Jun. 20, 2008, respectively, which are hereby incorporated by reference.

What is claimed is:

1. A process cartridge comprising:

an electrophotograpbic photosensitive drum;

a developing roller configured to develop an electrostatic latent image formed on the electrophotographic photosensitive drum, the developing roller being movable between (i) a contact position in which the developing roller is in contact with the electrophotographic photosensitive drum to develop the electrostatic latent image and (ii) a spaced position in which the developing roller is spaced from the electrophotographic photosensitive drum;

a housing supporting the electrophotographic photosensitive drum and the developing roller; and a force receiving unit movably supported by the housing, the force receiving unit including: (a) a spacing force receiving portion movable between (i) a projected position in which the spacing force receiving portion is projected from the housing and is capable of receiving a spacing force to move the developing roller from the contact position to the spaced position and (ii) a standby position in which the spacing force receiving portion is retracted from the projected position toward an inside of the housing, (b) a projecting force receiving portion capable of receiving a projecting force to move the spacing force receiving portion from the standby position to the projected position, and (c) an elastic portion that is (i) elastically deformed when the protecting force receiving portion receives the projecting force while the spacing force receiving portion is prevented from moving to the projected position and (ii) elastically restored from the elastically deformed state when the projecting force receiving portion receives the projecting force while the spacing force receiving portion is no longer prevented from moving to the projected position, wherein the force receiving unit is configured to make a first distance through which the spacing force receiving portion moves from the standby position to the projected position larger than a second distance through which the projecting force receiving portion is moved by the projecting force.

2. A process cartridge according to claim 1, wherein the spacing force receiving portion is (i) capable of taking a regulated position between the standby position and the projected position when the elastic portion is in the elastically deformed state and (ii) movable from the regulated position to the projected position with transition of the elastic portion from the elastically deformed state to the elastically restored state.

3. A process cartridge according to claim 2, wherein the force receiving unit further comprises:

a projecting force receiving member having the projecting force receiving portion and the elastic portion; and a spacing force receiving member having the spacing force receiving portion, the spacing force receiving member being rotatable about a rotatable center in conjunction with movement of the projecting force receiving member so that the spacing force receiving portion moves from the standby position to the projected position via the regulated position.

4. A process cartridge according to claim 3, wherein the housing includes a drum frame supporting the electrophotographic photosensitive drum and a developing frame supporting the developing roller, the developing frame being movable relative to the drum frame to move the developing roller between the contact position and the spaced position.

5. A process cartridge according to claim 4, wherein the force receiving unit is movably supported by the developing frame.

6. A process cartridge according to claim 5, wherein the spacing force receiving member is rotatably supported by the developing frame and the projecting force receiving member is slidably supported by the developing frame.

7. A process cartridge according to claim 6, wherein, when the spacing force receiving portion is in the standby position, the spacing force receiving portion is not projected from the housing.

8. A process cartridge according to claim 6, wherein the process cartridge is detachably mountable to a main assembly of an electrophotographic image forming apparatus, and wherein, when the process cartridge is not mounted to the main assembly, the spacing force receiving portion is in the standby position.

9. A process cartridge according to claim 1, wherein, when the spacing force receiving portion is in the standby position, the spacing force receiving portion is not projected from the housing.

10. A process cartridge according to claim 1, wherein the process cartridge is detachably mountable to a main assembly of an electrophotographic image forming apparatus, and wherein, when the process cartridge is not mounted to the main assembly, the spacing force receiving portion is in the standby position.

11. A process cartridge according to claim 1, wherein the force receiving unit further comprises:

a projecting force receiving member having the projecting force receiving portion; and a spacing force receiving member having the spacing force receiving portion, the spacing force receiving member being movable in conjunction with movement of the projecting force receiving member by the projecting force so that the spacing force receiving portion moves from the standby position to the projected position.

12. A process cartridge according to claim 11, wherein the movement of the projecting force receiving member is linear movement, and wherein the spacing force receiving member is rotatable about a rotational center in conjunction with the linear movement of the projecting force receiving member.

13. A process cartridge according to claim 11, wherein the force receiving unit further comprises a rotatable gear member including (i) a first gear portion engaging with the projecting force receiving member and rotatable with the movement of the projecting force receiving member and (ii) a second gear portion engaging with the spacing force receiving member and rotatable with a rotation of the first gear portion to move the spacing force receiving portion from the standby position to the projected position.

* * * * *